US011123752B1

(12) United States Patent
Damak et al.

(10) Patent No.: US 11,123,752 B1
(45) Date of Patent: Sep. 21, 2021

(54) SYSTEMS, DEVICES, AND METHODS FOR COLLECTING SPECIES FROM A GAS STREAM

(71) Applicant: Infinite Cooling Inc., Somerville, MA (US)

(72) Inventors: Maher Damak, Cambridge, MA (US); Karim Khalil, Boston, MA (US); Carl Frederik Brasz, Cambridge, MA (US); Kripa Varanasi, Lexington, MA (US)

(73) Assignee: Infinite Cooling Inc., Somerville, MA (US)

( * ) Notice: Subject to any disclaimer, the term of this patent is extended or adjusted under 35 U.S.C. 154(b) by 0 days.

(21) Appl. No.: 16/917,741

(22) Filed: Jun. 30, 2020

Related U.S. Application Data

(60) Provisional application No. 62/982,737, filed on Feb. 27, 2020.

(51) Int. Cl.
*B03C 3/45* (2006.01)
*B03C 3/41* (2006.01)
(Continued)

(52) U.S. Cl.
CPC ..... *B03C 3/45* (2013.01); *B03C 3/41* (2013.01); *B03C 3/08* (2013.01); *B03C 3/145* (2013.01); *B03C 2201/04* (2013.01)

(58) Field of Classification Search
CPC combination set(s) only.
See application file for complete search history.

(56) References Cited

U.S. PATENT DOCUMENTS 1,343,482 A * 6/1920 Schmidt ..... B03C 3/40 96/38
2,588,111 A 3/1952 Hanneman
(Continued)

FOREIGN PATENT DOCUMENTS

CN 205341043 U 6/2016
CN 106423564 A 2/2017
(Continued)

OTHER PUBLICATIONS

Chrzan, K. L. and Streubel, H., Artificial Rain Test of Outdoor Long Rod Insulatators, Proceedings of the 16th International Symposium on High Voltage Engineering, ISBN:978-0-620-44584-9, Paper E-31:1-5, (2009).
(Continued)

*Primary Examiner* — Christopher P Jones
*Assistant Examiner* — Sonji Turner
(74) *Attorney, Agent, or Firm* — Choate, Hall & Stewart LLP; Kristen C. Buteau; Michael D. Schmitt

(57) ABSTRACT

An example of a species collection system includes a plurality of spaced-apart electrically conductive collectors and a plurality of emitter electrodes. In some embodiments, at least one emitter electrode is disposed between adjacent ones of the collectors. In some embodiments, the at least one emitter electrode extends beyond the collectors (e.g., in at least one dimension). Collectors may be aligned to a direction of gas flow from an outlet (e.g., of a cooling tower) to facilitate collection while minimizing interference with the gas flow. Different emitter electrodes may be maintained at different voltages. In some embodiments, collectors are attached to a collector frame and emitter electrodes are attached to emitter frame(s) that are electrically insulated from the collector frame. Collectors may span a gas outlet (e.g., of a cooling tower) and emitter frame(s) may be
(Continued)

positioned outside of the collectors (e.g., and outside of a periphery of the gas outlet).

27 Claims, 16 Drawing Sheets

(51) Int. Cl.
*B03C 3/08* (2006.01)
*B03C 3/145* (2006.01)

(56) References Cited

U.S. PATENT DOCUMENTS 2,708,488 A 5/1955 Larsson
2,987,137 A * 6/1961 Brixius ..... B03C 3/86 96/79
3,040,497 A 6/1962 Schwab
3,600,653 A 8/1971 Hall
3,816,980 A 6/1974 Schwab
3,923,935 A 12/1975 Cates
3,934,817 A 1/1976 Barry et al.
3,972,701 A * 8/1976 Teel ..... B03C 3/40 96/88
4,098,854 A 7/1978 Knirsch et al.
4,104,696 A * 8/1978 Cochran, Jr. ..... H01T 23/00 361/229
4,133,653 A 1/1979 Soltis
4,233,037 A * 11/1980 Pontius ..... B03C 3/38 95/79
4,249,391 A 2/1981 Taylor
4,360,366 A * 11/1982 Collins ..... B03C 3/16 96/45
4,362,538 A * 12/1982 Cox ..... B03C 3/86 96/44
4,502,872 A * 3/1985 Ivester ..... B03C 3/41 96/90
4,514,344 A 4/1985 Ruscheweyh
4,514,780 A * 4/1985 Brussee ..... B03C 3/86 361/226
4,662,902 A 5/1987 Meyer-Pittroff
4,670,026 A 6/1987 Hoenig
4,715,870 A 12/1987 Masuda et al.
5,264,014 A 11/1993 Lannefors et al.
5,275,643 A 1/1994 Usui
5,449,036 A 9/1995 Genge et al.
6,096,119 A * 8/2000 Ho ..... B03C 3/12 96/21
6,152,378 A 11/2000 Alekseevich et al.
6,156,104 A * 12/2000 Jeong ..... B03C 3/70 96/88
6,302,944 B1 10/2001 Hoenig
6,576,046 B2 6/2003 Pruette et al.
6,679,940 B1 * 1/2004 Oda ..... A61L 9/22 96/55
6,872,238 B1 * 3/2005 Truce ..... B01D 49/00 95/29
7,090,717 B2 * 8/2006 Kim ..... B03C 3/09 96/100
7,485,174 B2 2/2009 Wang
7,540,903 B2 * 6/2009 Ladrech ..... B03C 3/41 96/83
7,833,323 B2 * 11/2010 Takayanagi ..... B03C 3/74 96/24
8,337,600 B2 * 12/2012 Paur ..... B03C 3/86 96/58
8,425,657 B2 4/2013 Ursem et al.
8,814,995 B2 * 8/2014 Johansson ..... B03C 3/47 96/79
9,073,079 B2 7/2015 Schulze et al.
9,308,537 B2 4/2016 Krichtafovitch
9,610,587 B2 * 4/2017 Roux ..... F24F 3/166
9,789,494 B2 10/2017 Wiser, III et al.
2002/0134665 A1 9/2002 Taylor et al.
2005/0152818 A1 7/2005 Botvinnik et al.
2006/0130658 A1 6/2006 Chang et al.
2007/0063361 A1 3/2007 Palmer
2009/0235821 A1 * 9/2009 Mochizuki ..... B03C 3/86 96/83
2010/0037776 A1 2/2010 Chan
2011/0203459 A1 8/2011 Swoboda et al.
2011/0227236 A1 9/2011 Vouche et al.
2012/0180512 A1 7/2012 Laing et al.
2013/0047857 A1 2/2013 Bohlen
2013/0228941 A1 9/2013 Bogh et al.
2013/0233365 A1 * 9/2013 Loos ..... E04H 15/644 135/114
2014/0260987 A1 9/2014 Park et al.
2015/0290352 A1 * 10/2015 Ota ..... F24F 3/1603 422/121
2015/0343454 A1 * 12/2015 Tyburk ..... B01D 46/50 95/70
2015/0360235 A1 12/2015 Ueda et al.
2015/0375237 A1 12/2015 Kojima et al.
2017/0354979 A1 12/2017 Krichtafovitch
2018/0078950 A1 3/2018 Sato et al.
2018/0178222 A1 * 6/2018 Tolvanen ..... B03C 3/08
2018/0272358 A1 9/2018 Damak et al.
2019/0039077 A1 2/2019 Jeon et al.
2019/0351431 A1 11/2019 Krichtafovitch
2020/0353480 A1 11/2020 Lee et al.
2020/0360935 A1 11/2020 Lee et al.
2020/0368757 A1 11/2020 Lee et al.
2020/0368760 A1 11/2020 Lee et al.
2021/0031212 A1 2/2021 Damak et al.
2021/0031213 A1 2/2021 Damak et al.

FOREIGN PATENT DOCUMENTS

DE 102007061199 A1 * 6/2009 ..... B01D 53/323
EP 0009857 A2 * 4/1980 ..... B03C 3/38
KR 101460663 B1 11/2014
WO WO-9857750 A1 * 12/1998 ..... B03C 3/86
WO WO-2012/072829 A1 6/2012
WO WO-2017/058949 A1 4/2017

OTHER PUBLICATIONS

Daal, L. et al., Evaluation of different water vapor capture technologies and energy modeling results for membrane technology, Icapwa, DNV-KEMA the Netherlands, Department PGR-PCW, P.O. Box 9035, 6800 ET Arnhem, The Netherlands, Combined Paper ID: 186 & 192, 21 pages, (2012).
Kraemer, H. and Johnstone, H.F., Collection of Aerosol Particles in Presence of Electrostatic Fields, Industrial and Engineering Chemistry, 47(12):2426-2434 (1955).
Levy, E. et al., Recovery of Water From Boiler Flue Gas—Final Technical Report, 97 pages (issued Dec. 2008).
Lindahl, P. et al., Plume Abatement—The Next Generation, Cooling Technology Institute, Presented at the 2010 Cooling Technology Institute Annual Conference, 10 pages (Feb. 7-11, 2010).
Tyagi, S.K. et al., Formation, potential and abatement of plume from wet cooling towers: A review, Renewable and Sustainable Energy Reviews, 16:3409-3429 (2012).
Uchiyama, H. and Jyumonji, M., Field experiments of an electrostatic fog-liquefier, Journal of Electrostatics, 35:133-143 (1995).
Uchiyama, H. and Jyumonji, M., Development of an Electrostatic Fogliquefier and its Field Experiments, Japanese Journal of Applied Physics, Japan Society of Applied Physics, 28(11):the whole document (1989).
International Search Report for PCT/US2020/040352 (Systems, Devices, and Methods for Collecting Species From a Gas Stream, filed Jun. 30, 2020) received by ISA/EP, 7 pages (dated Jan. 11, 2021).
Written Opinion for PCT/US2020/040352 (Systems, Devices, and Methods for Collecting Species From a Gas Stream, filed Jun. 30, 2020) received by ISA/EP, 19 pages (dated Jan. 11, 2021).

* cited by examiner

No E field

With electric field

SYSTEMS, DEVICES, AND METHODS FOR COLLECTING SPECIES FROM A GAS STREAM

PRIORITY APPLICATION

This application claims the benefit of U.S. Provisional Patent Application No. 62/982,737, filed on Feb. 27, 2020, the disclosure of which is hereby incorporated by reference herein in its entirety.

TECHNICAL FIELD

This disclosure relates generally to systems, devices, and methods for collecting species from gas streams.

BACKGROUND

Cooling towers are heat rejection systems that are used to cool a stream of water to a desired temperature. Wet cooling towers use evaporative cooling where heat transfer takes place both through sensible heat of air and evaporation latent heat. Cooling towers use large quantities of water because they have to make up for the water losses they incur. Evaporation is the main water loss: once water is converted into vapor to reject heat, the generated vapor is released into the ambient air where it is permanently lost.

When vapor leaves the tower, it may, under certain ambient conditions, condense as it leaves the cooling tower and form a plume of fog. This usually happens when the ambient air is cold and/or humid. Regulatory requirements relating to safety (drifting plumes can reduce visibility on roads and airports) and aesthetics, force some cooling towers to be equipped with plume abatement systems, which generally heat the exiting vapor and decrease its moisture content, either by heat exchangers or by blowing hot dry air and mixing it with the exiting vapor, thereby preventing the formation of fog droplets at the outlet of the tower. These abatement systems are able to remove the appearance of the plume, however the plant consumes the same amount of water, and lowers its overall net energy efficiency due to the added heat it has to create or redirect to the cooling tower outlets.

Several plume abatement systems have been developed to reduce fogging at the outlet of a cooling tower. One design relies on adding heat sources to the saturated air leaving the tower. By placing heat exchangers at the "wet section" of the tower, e.g., the part where air is saturated, the air is heated without any increase in the moisture content. This leads to a decrease in the relative humidity of the exiting air, which is not saturated anymore, and diminishes the probability of plume formation when air exists the tower. Another design relies on heating the air in a "dry section" and mixing it with the saturated exiting air. It also relies on heat exchangers, which heat some of the ambient air. The air is then drawn though fans to the wet section of the tower, mixed with the moist air, and the exiting mixture then has a lower relative humidity and is therefore less prone to fogging. A third design consists of adding a condensation module, which is a heat exchanger that cools down the exiting moist air, making some of it condense on the surface of the heat exchanger, thereby reducing the moisture content in the air. The air leaving the tower after the condenser module has then less relative humidity and it is less likely to form fog as it contacts the ambient air. All three of these designs require considerable additional investment in equipment and energy for a cooling tower, and some of them (in particular the first two designs above) do not result in any water recovery.

In addition to plume elimination, water losses are an important problem for cooling towers, and some devices have been designed to collect the exiting vapor from cooling towers to reuse it again in the cycle. One method to capture vapor is through liquid sorption. Using a liquid desiccant that is put into contact with the exiting moist air, vapor sorption in the desiccant occurs and the water is recovered and stored in the desiccant. This method can capture a significant part of the exiting vapor. However, significant energy has to be provided to then extract the collected liquid from the desiccant. Another method is through solid sorption, using solid desiccants. This method is similar to the previous one, except that it uses a solid as a desiccant. It can generally achieve very low moisture contents and is more costly. A third method is condensation through cooling. It consists in using heat exchangers in the wet section of the tower to cool the air and condense part of it. The condensate is then captured and can be reused. Such a setup is costly in equipment and, depending on the way the cooling is done, may be costly in energy as well.

SUMMARY

The present disclosure describes, inter alia, systems for collecting one or more species from a gas stream and methods of their use. Examples of applications where species may be collected from a gas stream include cooling towers, chimneys, steam vents, steam exhausts, HVAC systems, and combustion exhausts. A collected species may be an aerosolized or vaporized fluid, such as water. Systems described herein can be used to collect species near an outlet for a gas stream (e.g., an outlet of a cooling tower) or in the middle of a gas stream (e.g., somewhere along a duct of exhaust or other HVAC system). In certain embodiments using an emitter electrode, ion injection is used to charge droplets in a gas stream and attract them to an electrically conductive collector (e.g., a collecting electrode) with an electric field. Ion injection may occur due to corona discharge around an emitter electrode caused by maintaining the emitter electrode at a high voltage (e.g., over 10 kV). Systems described herein may be used for plume abatement while also collecting fluid (e.g., water) for later reuse (if desired). In some embodiments, plume abatement can occur at much lower cost than conventional systems, at least in part because energy requirements for operation may be much lower than in conventional systems.

A species collection system may include a plurality of electrically conductive collectors and a plurality of emitter electrodes. In some embodiments, emitter electrodes are disposed between (e.g., at least partially between) adjacent collectors. For example, at least one of a plurality of emitter electrodes may be disposed between two collectors. For example, each adjacent pair of collectors may have at least one (e.g., multiple) emitter electrodes disposed between them. Collectors may be aligned to a direction of gas flow from an outlet (e.g., of a cooling tower) to facilitate collection while minimizing interference with the gas flow. Different emitter electrodes may be maintained at different voltages and/or have different curvatures. In some embodiments, collectors are attached to a collector frame and emitter electrodes are attached to emitter frame(s), where the emitter frame(s) are electrically insulated from the collector frame. Collectors may have a size that spans a gas outlet (e.g., of a cooling tower) and emitter frame(s) may be positioned outside of the collectors (e.g., outside of a periphery of the gas outlet).

Systems and methods disclosed herein can have one or more advantages over other species capture (e.g., plume abatement) systems including one or more of the following advantage. Cooling towers and other exhausts are sensitive to pressure drop, which can limit their efficiency. By aligning collectors to a direction of gas flow from a gas outlet (e.g., such that they are parallel to each other and the direction of gas flow), a pressure drop caused by the presence of a species collection system disclosed herein can be minimized. Systems disclosed herein can have high efficiency in a wide range of conditions (e.g., wind speed, droplet size). Systems can be light weight by being constructed from low density components, such as thin wire emitter electrodes and wire mesh collectors, for example. Systems can also be low power consumers. For example, in some embodiments, where different emitter electrodes or conductive elements (e.g., plates) are maintained at different voltages, power consumption can be reduced while maintaining high species capture rates. These and other advantages are described in further detail in subsequent paragraphs.

In some aspects, the present disclosure is directed to a system for collecting a species (e.g., water) from a gas stream (e.g., exhaust from a cooling tower). The system may include a plurality of electrically conductive collectors that are spaced apart. The system may include a plurality of emitter electrodes. At least one of the plurality of emitter electrodes may be disposed between two of the plurality of electrically conductive collectors.

In some embodiments, for each pair of adjacent collectors in the plurality of electrically conductive collectors, at least one of the plurality of emitter electrodes is disposed between the adjacent collectors. In some embodiments, the at least one of the plurality of emitter electrodes includes two emitter electrodes. In some embodiments, the two emitter electrodes are spaced apart in a direction perpendicular to a direction in which the plurality of electrically conductive collectors are spaced apart. In some embodiments, one of the two emitter electrodes is maintained at a first voltage and the other of the two emitter electrodes is maintained at a second voltage, wherein the first voltage is higher than the second voltage. In some embodiments, the one of the two emitter electrodes is closer to a gas outlet than the other of the two emitter electrodes. In some embodiments, the first voltage is sufficient to generate ions in a gas stream (e.g., via corona discharge) and the second voltage is insufficient to generate ions in the gas stream. In some embodiments, the at least one of the plurality of emitter electrodes is disposed between a pair of adjacent collectors in the plurality of electrically conductive collectors. An emitter separation between adjacent ones of the at least one of the plurality of emitter electrodes may be from a fourth to five times a collector separation between the adjacent collectors. In some embodiments, the two emitter electrodes are two non-identical emitter electrodes. In some embodiments, the two non-identical emitter electrodes includes a first wire and a second wire having a smaller radius of curvature than the first wire. In some embodiments, the emitter electrodes extend beyond the collectors in at least one dimension (e.g., only one dimension).

In some embodiments, for at least one pair of two adjacent collectors in the plurality of electrically conductive collectors, an electrically conductive plate and at least one of the plurality of emitter electrodes is disposed between the two adjacent collectors and the electrically conductive plate is laterally separated from the at least one of the plurality of emitter electrodes. In some embodiments, the electrically conductive plate and the at least one of the plurality of emitter electrodes lie in, and are parallel to, a common plane. In some embodiments, the plate is disposed further from a gas outlet than the at least one of the plurality of emitter electrodes. In some embodiments, the plate is maintained at a voltage (e.g., lower than a voltage at which the at least one of the plurality of emitter electrodes is maintained).

In some embodiments, the system includes a collector frame and a first emitter frame, wherein the electrically conductive collectors are attached to the collector frame and the plurality of emitter electrodes are attached to the first emitter frame, and wherein the collector frame is electrically insulated from the first emitter frame. In some embodiments, the first emitter frame includes one or more electrically conductive elongated emitter connection members (e.g., one or more metal rods) and each of the plurality of emitter electrodes is attached to (e.g., is wrapped at least partially around) at least one of the one or more emitter connection members. In some embodiments, the system includes a second emitter frame that includes one or more electrically conductive elongated emitter connection members (e.g., one or more metal rods), wherein each of the plurality of emitter electrodes also is attached to (e.g., also is wrapped at least partially around) at least one of the one or more emitter connection members and the second emitter frame and the first emitter frame as disposed on opposite sides of the collectors. In some embodiments, the one or more emitter connection members is a plurality of emitter connection members that are spatially separated (e.g., evenly) (e.g., along a direction of gas flow from a gas outlet) and mutually parallel. In some embodiments, the one or more emitter connection members are perpendicular to respective surfaces of the electrically conductive collectors.

In some embodiments, for each of the one or more emitter connection members, each of the plurality of emitter electrodes that is attached to the emitter connection member is commonly electrically connected (e.g., to a single voltage input) (e.g., through the emitter connection member). In some embodiments, for each of the one or more emitter connection members, a subset (e.g., all or only a portion) of the plurality of emitter electrodes is attached to the emitter connection member and different emitter electrodes of the subset are disposed between different pairs of adjacent ones of the plurality of electrically conductive collectors. In some embodiments, each of the plurality of emitter electrodes that is attached to a respective one of the one or more emitter connection members is evenly spaced (e.g., within 5%) along the respective one of the one or more emitter connection members. In some embodiments, the one or more emitter connection members is a plurality of emitter connection members and each of the plurality of emitter electrodes is attached to (e.g., wraps at least partially around) at least two of the plurality of emitter connection members.

In some embodiments, the system includes one or more electrically insulating members that attach the first emitter frame to the collector frame and electrically insulate the collector frame from the first emitter frame (e.g., and one or more electrically insulating members that attach the second emitter frame to the collector frame and electrically insulate the second emitter frame from the collector frame). In some embodiments, each of the one or more electrically insulating members is enclosed in a respective housing. In some embodiments, the one or more emitter connection members extend into the respective housing. In some embodiments, the respective housing includes electrically conductive material (e.g., metal) or electrically insulating material (e.g., fiberglass or garolite). In some embodiments, the one or more electrically insulating members are each disposed within a respective casing (e.g., thereby environmentally sealing the one or more electrically insulating members).

In some embodiments, the first emitter frame (e.g., and the one or more electrically insulating members that attach the first emitter frame to the collector frame) is disposed outside of a periphery of a gas outlet [e.g., and the second emitter frame (e.g., and the one or more electrically insulating members that attach the second emitter frame to the collector frame) is disposed outside of the periphery of the gas outlet].

In some embodiments, the plurality of electrically conductive collectors at least partially (e.g., around a periphery of a gas outlet) enclosed by a shielding (e.g., including one or more panels) (e.g., wherein the shielding at least partially encloses the frame to which the plurality of electrically conductive collectors are attached) (e.g., wherein the shielding is open along a direction of gas flow and is otherwise enclosed).

In some embodiments, the plurality of electrically conductive collectors are mutually parallel (e.g., within 10 degrees). In some embodiments, spacing between adjacent ones of the plurality of electrically conductive collectors varies no more than 10% (e.g., no more than 5%, no more than 3%, or no more than 1%). In some embodiments, a separation between adjacent collectors in the plurality of electrically conductive collectors is from one inch to three feet (e.g., from two inches to two feet).

In some embodiments, the system includes a frame, wherein the plurality of electrically conductive collectors are attached to the frame (e.g., wherein the frame includes a collector frame). In some embodiments, the plurality of emitter electrodes are attached to the frame (e.g., by one or more electrically insulating members) (e.g., wherein the frame includes one or more emitter frames).

In some embodiments, the electrically conductive collectors are meshes held under tension by one or more tensioning cables. In some embodiments, the one or more tensioning cables are attached to a rigid frame (e.g., including one or more pieces of rigid edging). In some embodiments, each of the electrically conductive collectors is attached to one or more pieces of edging and the one or more pieces of edging are held under tension (e.g., by one or more springs) such that the electrically conductive collectors are held under tension. In some embodiments, the system includes one or more respective rigidifying members (e.g., rods) attached to an interior portion of each of the plurality of electrically conductive collectors. In some embodiments, the system includes a rigid frame (e.g., including one or more pieces of rigid edging), wherein the electrically conductive collectors are attached to the rigid frame (e.g., at a perimeter of the electrically conductive collectors).

In some embodiments, the system includes a gutter disposed at an edge of one of the plurality of electrically conductive collectors (e.g., wherein the gutter is a common gutter for at least some of the plurality of electrically conductive collectors or is a respective gutter for only the one of the plurality of electrically conductive collectors). In some embodiments, the edge of one of the plurality of electrically conductive collectors is disposed in the gutter (e.g., wherein the gutter is attached to two opposing surfaces of the one of the plurality of electrically conductive collectors). In some embodiments, the gutter includes one or more collection wings (e.g., to direct collected fluid down into the gutter). In some embodiments, the gutter includes a tubular member into which fluid can drain from the one of the plurality of electrically conductive collectors (e.g., and the tubular member has a circular or rectangular cross section). In some embodiments, the gutter is in fluid communication with a collection conduit.

In some embodiments, the system includes a motion stage, wherein the plurality of electrically conductive collectors and the plurality of emitter electrodes are mounted (e.g., directly or indirectly) on the motion stage and the motion stage is operable to move the plurality of electrically conductive collectors and the plurality of emitter electrodes. In some embodiments, the motion stage is operable to independently move different ones of the plurality of electrically conductive collectors and the plurality of emitter electrodes (e.g., independently move subsets thereof that are attached to different frames). In some embodiments, the motion stage is operable to move while the plurality of electrically conductive collectors and the plurality of emitter electrodes remain in a fixed relative position. In some embodiments, the motion stage is operable to move the plurality of electrically conductive collectors and the plurality of emitter electrodes vertically relative to a gas outlet.

In some embodiments, the plurality of electrically conductive collectors and the plurality of emitter electrodes are disposed in a curved (e.g., hemispherical) or pyramidal arrangement [e.g., while being parallel (e.g., within 10 degrees) to a direction of gas flow from a gas outlet].

In some embodiments, the system is disposed on, in, or over a gas outlet (e.g., a cooling tower outlet). In some embodiments, the plurality of electrically conductive collectors and the plurality of emitter electrodes are disposed at least 0.5 m above the gas outlet. In some embodiments, the plurality of electrically conductive collectors and the plurality of emitter electrodes are disposed away from the gas outlet by a distance of no more than five times (e.g., no more than three times) an extent (e.g., diameter) of the gas outlet. In some embodiments, the system is disposed near (e.g., on or in) the gas outlet such that the plurality of are disposed near (e.g., in) (e.g., within 8 m) a surface (e.g., plane) of maximum fluid content of gas exiting the gas outlet [e.g., a surface of maximum water content of air exiting the gas outlet (e.g., an outlet of a cooling tower)]. In some embodiments, the plurality of electrically conductive collectors are aligned (e.g., to within 25 degrees) to a direction of gas flow out of the gas outlet. In some embodiments, the plurality of electrically conductive collectors are perpendicular (e.g., within 10 degrees) to the gas outlet. In some embodiments, for at least one pair of adjacent collectors in the plurality of electrically conductive collectors, a first emitter electrode and a second emitter electrode of the plurality of emitter electrodes are disposed between the adjacent collectors, wherein the first emitter electrode is disposed further from the gas outlet than the second emitter electrode. In some embodiments, the first emitter electrode is a wire and the second emitter electrode is a wire of smaller diameter. In some embodiments, at least a portion of the plurality of emitter electrodes are wires oriented horizontally or vertically relative to a direction of gas flow out of the gas outlet. In some embodiments, the electrically conductive collectors each have a width that spans a width of the gas outlet. In some embodiments, the electrically conductive collectors each have a height in inches that is in a range from $h_0$ to $20h_0$ where $$h_0 = \frac{3 * \text{air speed}\left(\frac{m}{s}\right) * \text{distance between collectors (inches)}}{\text{Droplet or particle diameter } (\mu m)}.$$

In some embodiments, each of the plurality of electrically conductive collectors has a length to width aspect ratio of greater than one and the longer of the length and the width is aligned with a direction of gas flow from the gas outlet.

In some embodiments, the system comprises one or more wind breaks (e.g., disposed around a periphery of a gas outlet, e.g., around a periphery of a system for species collection). In some embodiments, the one or more wind breaks are disposed above a gas outlet and below a top of the plurality of emitter electrodes and the plurality of collectors. In some embodiments, the one or more wind breaks comprises one or more louvers (e.g., that are angled relative to ground level). In some embodiments, the one or more wind breaks comprise one or more curved structures (e.g., that are disposed concentrically to the gas outlet).

In some embodiments, the plurality of emitter electrodes includes one or more of round wires, square wires, rods with sharp edges, and an array of needles. In some embodiments, plurality of emitter electrodes includes wires under tension (e.g., under at least 0.5 N and no more than 20 N of tension). In some embodiments, each of the plurality of emitter electrodes includes one or more of titanium, tungsten, copper, steel (e.g., stainless steel, galvanized steel, or mild steel), Inconel.

In some embodiments, each of the plurality of electrically conductive collectors includes one or more of stainless steel, galvanized steel, mild steel, aluminum, copper, titanium and Inconel. In some embodiments, each of the plurality of electrically conductive collectors is a mesh (e.g., including a plurality of wires) or a plate (e.g., having one or more holes therethrough and/or is a corrugated plate). In some embodiments, each of the plurality of electrically conductive collectors is planar, cylindrical, spiral, or conical.

In some embodiments, system includes one or more collection panels and the one or more collection panels each include at least one of the plurality of electrically conductive collectors and at least one of the plurality of emitter electrodes attached to and electrically insulated from the at least one of the plurality of electrically conductive collectors. In some embodiments, the plurality of emitter electrodes are electrically insulated (e.g., isolated) from the plurality of electrically conductive collectors and the plurality of electrically conductive collectors are grounded. In some embodiments, the plurality of emitter electrodes are maintained at a voltage and the voltage for at least some of the plurality of emitter electrodes is at least 1 kV and, optionally, no more than 500 kV [e.g., a voltage of at least 5 kV at least 10 kV, at least 15 kV, at least 25 kV, at least 50 kV, at least 100 kV) (e.g., and no more than 250 kV, no more than 100 kV, or no more than 50 kV)].

In some aspects, the present disclosure is directed to a species collection device including an emitter electrode and a mesh electrically conductive collector. The species collection device may include one or more tensioning cables (e.g., metal cables). The one or more tensioning cables may run through the mesh collector (e.g., be woven through the mesh collector) with the one or more tensioning cables holding the mesh under tension. In some embodiments, the emitter electrode is disposed within 1 meter of the mesh electrically conductive collector. In some embodiments, the device includes a frame, wherein the one or more tensioning cables are attached to the frame.

In some aspects, the present disclosure is directed to device for collecting a species from a gas stream, the device including a plurality of electrically conductive collectors attached to a collector frame and an emitter electrode attached to an emitter frame. The emitter frame may be disposed outside of the collector frame. The emitter electrode may be electrically insulated from the plurality of electrically conductive collectors. The emitter frame may be disposed outside a periphery of a gas outlet (e.g., of a cooling tower).

In some aspects, the present disclosure is directed to a method for collecting a species from a gas stream. The method may include one or more of the following steps: flowing a gas stream including a species (e.g., a polar molecule, e.g., water) dispersed within the gas stream (e.g., wherein the species is aerosolized or a vapor) in a direction; charging the species; and collecting the charged species on surfaces of electrically conductive collectors using an electric field. The electrically conductive collectors may be aligned with the direction. In some embodiments, the method includes draining the charged species, via gravity, into a gutter. In some embodiments, an emitter electrode causes the charging (e.g., by providing one or more free charges into the gas flow, e.g., via corona discharge). In some embodiments, the emitter electrode is disposed between two adjacent ones of the electrically conductive collectors. In some embodiments, the method includes providing a system as disclosed herein, wherein the system includes the electrically conductive collectors (e.g., and the emitter electrode). In some embodiments, the electric field has a strength from 75 to 800 kV/m (e.g., and is generated using the emitter electrode). In some embodiments, the electric field spatially varies as a function of distance along the direction of the gas flow. In some embodiments, the electric field has a first strength at a proximal end of the gas flow and a second strength at a distal end of the gas flow that is different from the first strength (e.g., caused by applying different voltages to different emitter electrodes spatially separated along the direction of the gas flow).

In some embodiments, the method includes applying a first voltage to a first emitter electrode disposed relatively closer to a gas outlet that the gas stream flows from. The method may include applying a second voltage to a second emitter electrode disposed relatively further from the gas outlet. Charging the species and collecting the charged species may occur, at least in part, due to applying the first voltage and the second voltage. In some embodiments, the first voltage is sufficient to cause the first emitter electrode to generate ions (e.g., in the gas stream via corona discharge) and charge the species and the second voltage is sufficient to deflect the species towards a collector but not generate any ions.

In some embodiments, the method comprises directing ambient wind toward a gas outlet thereby forming a plume with water in air near the gas outlet, wherein the species is dispersed within the plume.

BRIEF DESCRIPTION OF THE DRAWINGS

Drawings are presented herein for illustration purposes, not for limitation. Figures are not necessarily drawn to scale. The foregoing and other objects, aspects, features, and advantages of the disclosure will become more apparent and may be better understood by referring to the following description taken in conjunction with the accompanying drawings, in which.

DETAILED DESCRIPTION OF CERTAIN EMBODIMENTS

Figure 1B:
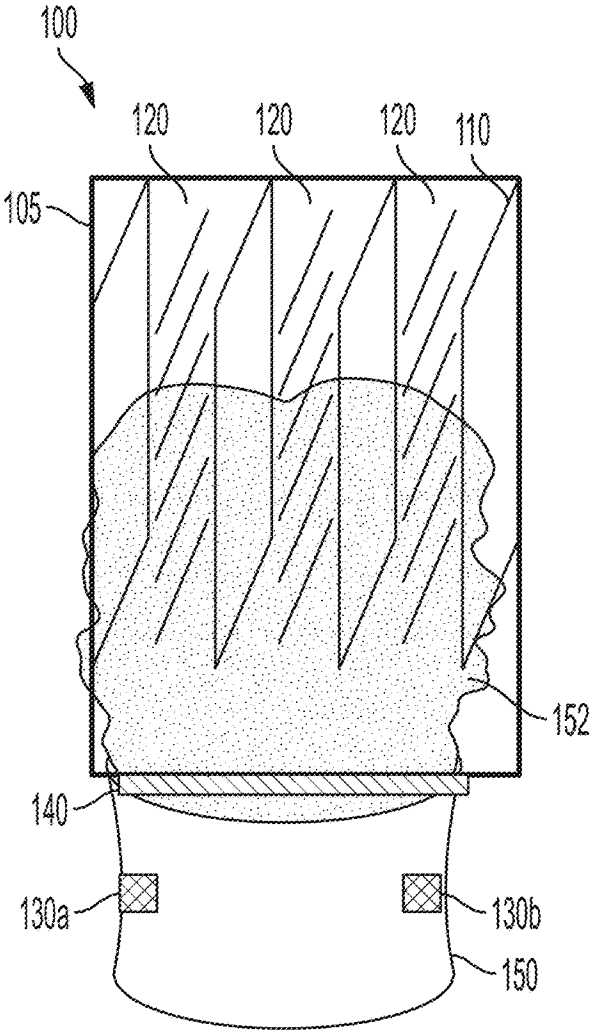
FIGS. 1A-1C show species collection systems, according to illustrative embodiments of the present disclosure.

It is contemplated that systems, devices, methods, and processes of the disclosure encompass variations and adaptations developed using information from the embodiments described herein. Adaptation and/or modification of the systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems according to certain embodiments of the present disclosure that consist essentially of, or consist of, the recited components, and that there are processes and methods according to certain embodiments of the present disclosure that consist essentially of, or consist of, the recited processing steps.

In this application, unless otherwise clear from context or otherwise explicitly stated, (i) the term "a" may be understood to mean "at least one"; (ii) the term "or" may be understood to mean "and/or"; (iii) the terms "comprising" and "including" may be understood to encompass itemized components or steps whether presented by themselves or together with one or more additional components or steps; (iv) the terms "about" and "approximately" may be understood to permit standard variation as would be understood by those of ordinary skill in the relevant art; and (v) where ranges are provided, endpoints are included. In certain embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

It should be understood that the order of steps or order for performing certain action is immaterial so long as operability is not lost. Moreover, two or more steps or actions may be conducted simultaneously.

A system disclosed herein may include, inter alia, a plurality of electrically conductive collectors and a plurality of emitter electrodes. The electrically conductive collectors may be spaced apart in at least a first dimension (e.g., horizontally spaced relative to a gas outlet). In some embodiments, at least one emitter electrode is disposed between two of the collectors (e.g., between adjacent ones of a plurality of collectors). In some embodiments, the at least one emitter electrode extends beyond the collectors (e.g., in at least one dimension). Emitter electrodes may be wires, needles, or other high curvature electrically conductive members. For any two (e.g., adjacent) collectors, more than one emitter electrode may be disposed therebetween. Collectors may be aligned to a direction of gas flow from an outlet (e.g., of a cooling tower) to facilitate collection while minimizing interference with the gas flow. Two emitter electrodes may be spaced apart in a direction perpendicular to a direction in which the plurality of electrically conductive collectors are spaced apart. Different emitter electrodes may be maintained at different voltages and/or have different curvatures. In some embodiments, collectors are attached to a collector frame and emitter electrodes are attached to emitter frame(s), where the emitter frame(s) are electrically insulated from the collector frame. Collectors may have a size that spans a gas outlet (e.g., of a cooling tower) and emitter frame(s) may be positioned outside of the collectors (e.g., outside of a periphery of the gas outlet).

Collectors are electrically conductive members. Collectors may be aligned with a direction of gas flow from a gas outlet (e.g., of a cooling tower). For example, collectors may be parallel (e.g., within 10 degrees) to a direction of gas flow. Examples of collectors are planar meshes, planar plates, cylindrical meshes, cylindrical plates, an array of wires, corrugated plates. Collectors may comprise metal. Materials that can be used include, but are not limited to, stainless steel, galvanized steel, mild steel, aluminum, copper, titanium and Inconel.

In some embodiments, species (e.g., droplets and/or particles) get charged as they travel between collectors (e.g., due to emitter electrode(s) disposed between the collectors) and are collected on the collectors. In some embodiments, collector(s) drain, at least in part due to gravity, into a gutter. Fluid collected into a gutter may be transported to elsewhere, for example through collection conduit attached to the gutter. In some embodiments, collectors have a width that spans the width of a gas outlet. Distance between collectors can be varied and is generally from one inch to three feet (e.g., from 2 inches to 2 feet). A height of collectors may be selected depending on multiple factors such as distance between them, size of droplets and/or particles and the speed of the air that is carrying them. A typical range for the height H in inches is $[h_0-20h_0]$ where $$h_0 = \frac{3 * \text{air speed}\left(\frac{m}{s}\right) * \text{distance between collectors (inches)}}{\text{Droplet or particle diameter } (\mu m)}.$$

Spacing between adjacent ones of the plurality of electrically conductive collectors varies no more than 10% (e.g., no more than 5%, no more than 3%, or no more than 1%). Collectors may be attached to a frame (e.g., that emitter electrode(s) are also attached to) (e.g., a collector frame). In some embodiments, each of a plurality of electrically conductive collectors has a length to width aspect ratio of greater than one and the longer of the length and the width is aligned with a direction of gas flow from a gas outlet. In some embodiments, collectors may not be parallel. In some embodiments, collectors may not be planar but have other shapes including, but not limited to, cylinders, spirals and cones.

Emitter electrodes are electrically conductive members. An emitter electrode may comprise metal. One or more emitter electrodes may be placed between collectors. One or more emitter electrodes may extend beyond collectors in at least one dimension. In the space between each two adjacent collectors there can be zero, one, or multiple emitter electrodes. Emitter electrodes can be or comprise round wires (e.g., having a diameter from 50 μm to 10 mm (e.g., 50 μm to 2 mm or 50 μm to 250 μm or 100 μm to 200 μm), square wires (e.g., having a side length from 50 μm to 10 mm (e.g., 50 μm to 2 mm or 50 μm to 250 μm or 100 μm to 200 μm)), rods with sharp edges, an array of needles, or other shapes that have locations of high curvature. In some embodiments, an emitter electrode comprises one or more of titanium, tungsten, copper, Inconel, and steel (e.g., stainless steel). Emitter electrodes may be placed in the middle of two electrodes (e.g., electrically conductive collectors). If there is more than one emitter electrode between adjacent collectors, the distance between them is typically between a fourth and five times the distance between the collectors, for example a vertical separation of emitter electrodes as compared to a horizontal separation between collectors. Emitter electrodes may include wires that run horizontally or vertically (relative to a direction of gas flow) but horizontally is more common. In some embodiments, emitter electrodes are connected to a power supply to be maintained at a certain voltage. In some embodiments, non-identical emitter electrodes are used. For example, a species collection system may include horizontal wires with a small radius at the bottom (e.g., nearer a gas outlet), followed by larger diameter wires on top (e.g., further from a gas outlet). Wire emitters can also be followed (e.g., in a direction of gas flow) by a plate or a low curvature electrode. The plate may function not to emit ions but just to maintain a strong electric field to enhance the attraction of species (e.g., droplets and/or particles) in the top region of collectors.

Figure 1A:
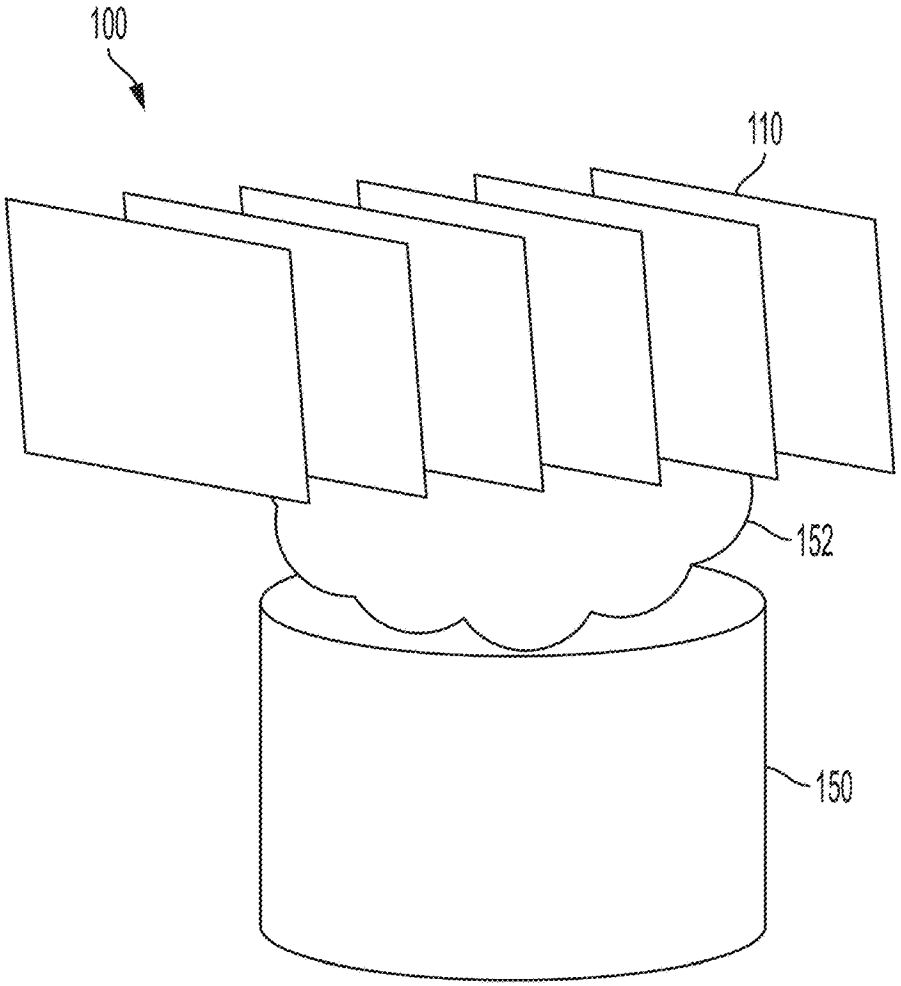

FIGS. 1A-1B show example arrangements of species collection system 100. Referring to FIG. 1A, electrically conductive collectors 110 are spaced apart horizontally relative to an outlet of cooling tower 150 from which plume 152 emanates. Collectors 110 are aligned along a direction of gas flow of plume 152. By aligning collectors 110 to the direction of gas flow (e.g., as opposed to arranging them perpendicular to the flow), a pressure drop across the collectors can be reduced. Emitter electrodes (hidden by collectors 110) and collectors 110 are assembled as collection panels in the arrangement shown in FIG. 1A. (See FIGS. 2A-2C and description below for details on illustrative collection panels). FIG. 1B shows a different view of a species collection system 100. Emitter electrodes 120 and collectors 110 are attached to frame 105, which is mounted on motion platform 140, which is in turn attached to cooling tower 150. Additional components **130*a-b* are included in cooling tower 150. Motion platform 140 and additional components 130*a-b*** are discussed further in subsequent paragraphs.

Figure 1C:
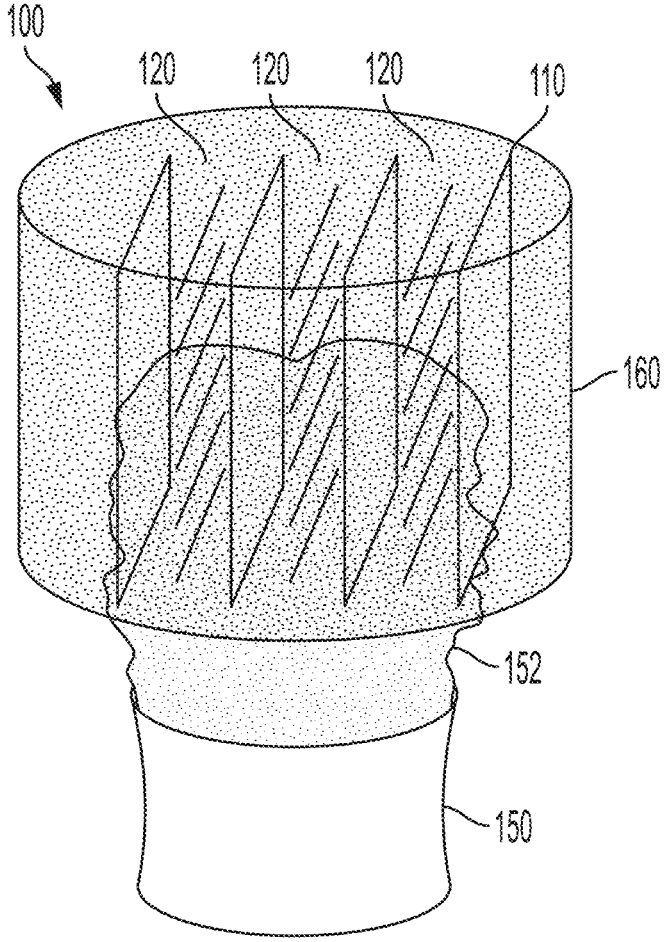

In some embodiments, a shielding (e.g., shroud and/or casing) at least partially encloses a plurality of collectors (e.g., around a periphery of a gas outlet). A shielding may comprise one or more panels. A shielding may be open along a direction of gas flow from a gas outlet and, optionally, be otherwise enclosed. An example of species collection system 100 that includes shielding 160 is shown in FIG. 1C. A shielding may protect emitter electrodes and collectors from external winds. It may also provide additional structural support and can have mounting points that are used to attach collectors and/or emitter electrodes (e.g., collector frames and/or emitter frames that in turn attach to the collectors and/or emitter electrodes, respectively). A shielding may provide a convenient structure by which to lift/carry a system with a crane.

A shielding may shield a system from any negative effects of wind. Accordingly, a shielding could be made of a either metallic or plastic/composite material. The material may be either completely opaque, or is a partially transparent material. A shielding may have a lower percentage of open area than a collector mesh so that it catches the majority of the wind that is hitting it. A shielding could be attached to collectors in several ways. In some embodiments, collectors share a common structural support (for example two circular structural member that they are all tensioned against that holds them all from the top and bottom). A shielding could be attached to these structural rings holding the collectors in place. A shielding may catch and/or redirect wind in such a way that the wind is less of a dominant effect on a plume that is escaping a cooling tower. The plume would thus be able to rise vertically through a species collection system more easily without being caught by the wind, which would displace the plume horizontally as it rises through the system.

A shielding may also potentially provide overall rigidity to the system. A system of tensioned electrically conductive mesh collectors may benefit from additional rigidity so the entire system is capable of being picked up via crane and doesn't buckle when picked from its top portion. In some embodiments, a shielding would only encase emitter electrodes and collectors. In some embodiments, a shielding could also extend below collectors and emitter electrodes so that it partially overlaps with a shroud of a gas outlet (e.g., of a cooling tower) so that wind effects are even less pronounced between any gap between a system and the gas outlet.

Figure 12A:
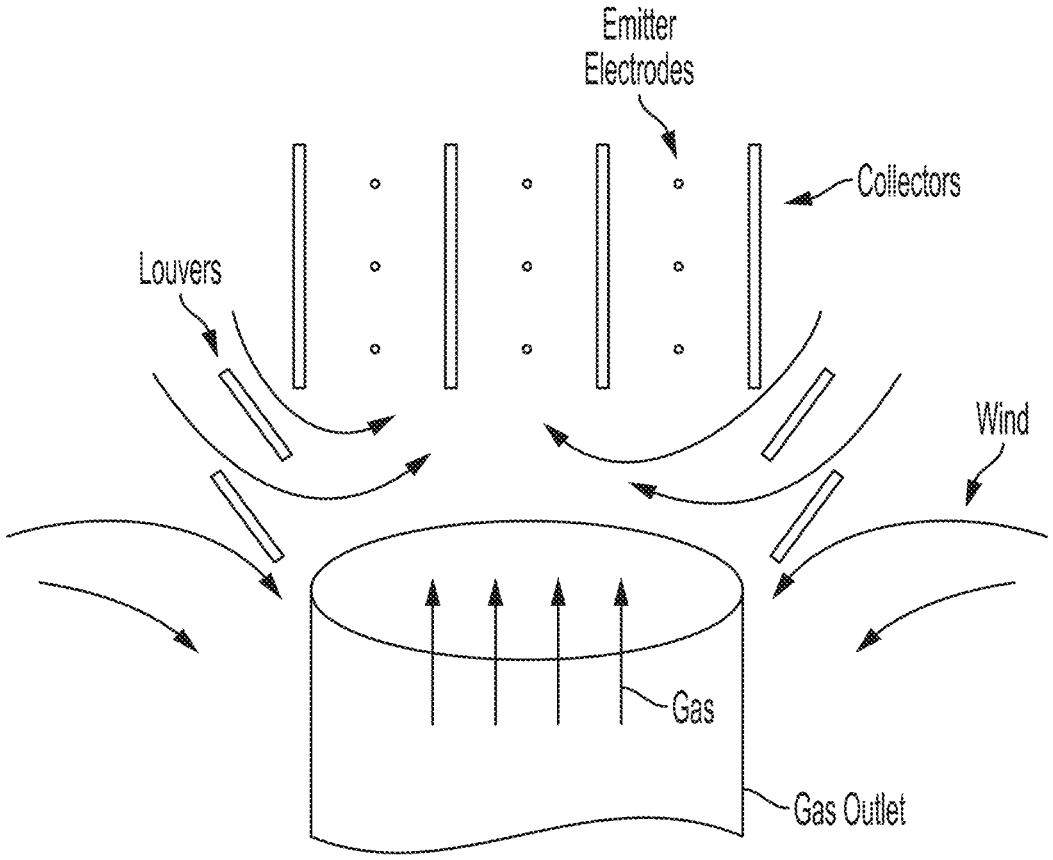
FIGS. 12A-12B show examples of species collection systems that include one or more wind breaks, according to illustrative embodiments of the present disclosure.
Figure 12B:
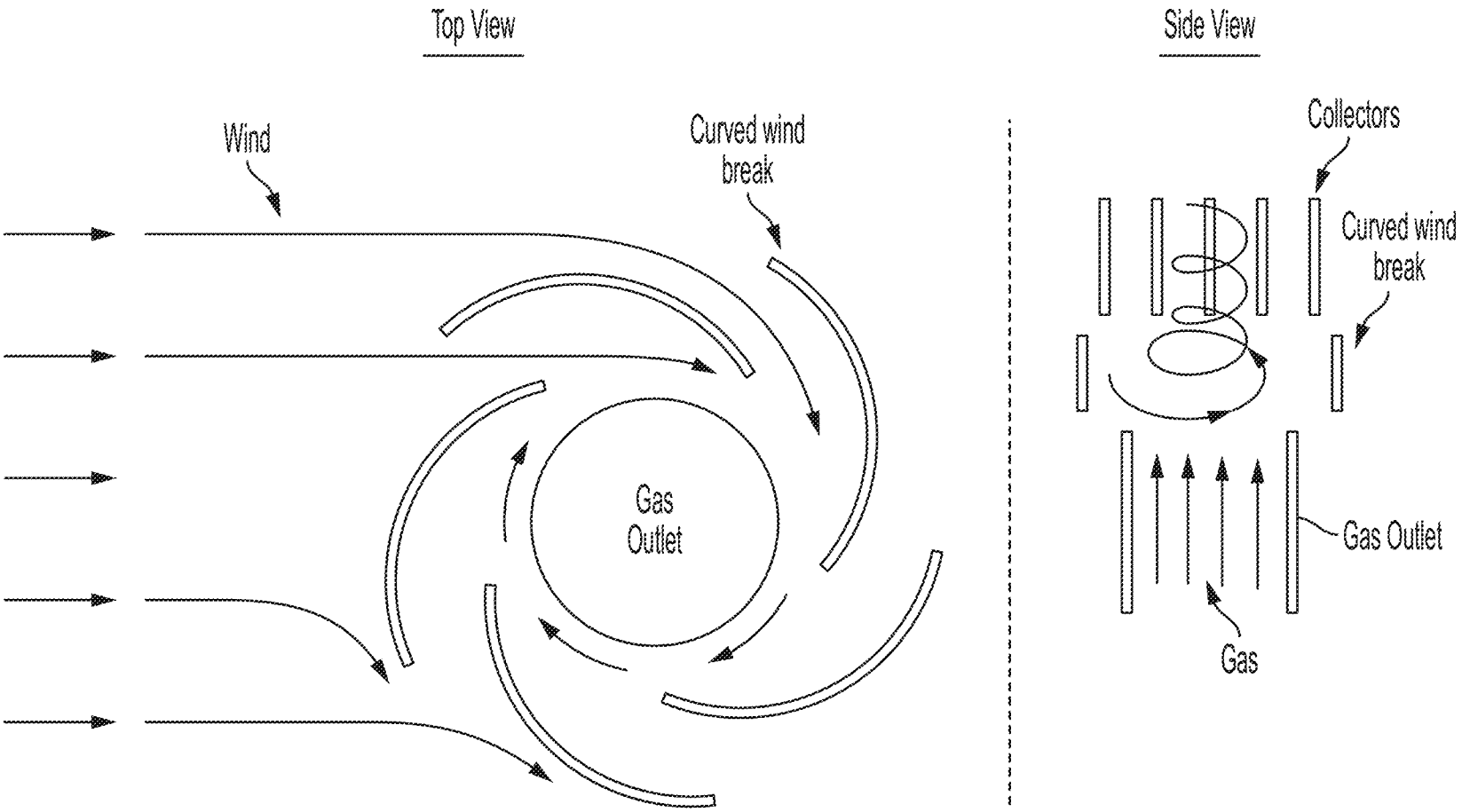

In some embodiments, for example as shown in FIGS. 12A-12B, one or more wind breaks may be disposed above or after a gas outlet and before and/or along emitter electrodes and collectors of a species collection system to protect from cross winds. Wind break(s) can also be used to not only break the wind but also channel the wind and induce mixing of ambient air with gas coming out of an outlet, for example in order to induce plume formation. By inducing plume formation, species (e.g., water) collection may be improved. Some examples of wind breaks are inclined louvers (e.g., as shown in FIG. 12A) that would still allow some of the wind in (e.g., at reduced velocity) or curved structures (e.g., concentric to a gas outlet) (e.g., as shown in FIG. 12B) that would introduce part of the wind stream tangentially. An additional benefit of curved wind breaks, in some embodiments, is to induce swirls after introducing wind, causing more mixing in the area between the gas outlet and the collectors.

In some embodiments, a system comprises one or more wind breaks that are disposed above a gas outlet and below and/or along the plurality of emitter electrodes and the plurality of collectors. In some embodiments, the one or more wind breaks includes one or more louvers (e.g., that are angled relative to ground level, for example as shown in FIG. 12A). In some embodiments, the one or more wind breaks includes one or more curved structures (e.g., that are disposed concentrically to the gas outlet) (e.g., such that they tangentially direct wind toward a gas outlet) (e.g., as shown in FIG. 12B).

Collectors (and/or emitter electrodes) may be positioned in a plume emanating from a gas outlet (e.g., of a cooling tower). Often water plumes are in a transient state. They start as saturated air at the outlet (e.g., of the cooling tower), condense as supersaturated conditions are reached, and then evaporate again when more air gets mixed in. Thereby, there may be only a small spatial window (relative to a size of the cooling tower) where water droplets are in the air and collection desirably happens there. Collectors may be placed coincident (e.g., in) a surface of maximum water content in order to maximize collection.

In some embodiments, the system may be held at a certain height where there is a gap between the cooling tower outlet and the bottom of the collection system. That height can be adjusted as a function of parameters such as water and air flow rates, external winds if any, temperature and humidity of the air coming out of the exhaust and of the ambient air. In some embodiments, the height is between zero and five (e.g., zero and three) gas outlet diameters.

In some embodiments, one or more collection panels are disposed to maximize fluid collection. For example, a plume from a cooling tower being abated is in transient state. The plume starts as saturated air at the outlet of the cooling tower, condenses as supersaturated conditions are reached, and then evaporates again when more air gets mixed in. Thus, in some embodiments, there may be only a relatively small spatial window where water droplets are in the air and collection may preferably occur there. Models have been developed to predict the surface of maximum fluid content so that collection panel(s) can be placed at the location where it can collect the most. A location (or range of locations) of a surface of maximum water content can also be determined empirically from measurements (e.g., humidity measurements) at various times (e.g., under various ambient conditions). A surface of maximum fluid content can be a planar surface or a non-planar surface (e.g., three-dimensionally rounded surface). The physical location and shape of a surface may depend on, for example, the geometry of an air outlet or duct, the amount of fluid dispersed in the gas stream, and ambient conditions such as temperature and pressure. The physical location or shape of a surface may change based on a change in wind velocity (e.g., direction and/or speed). Arranging collection panel(s) relatively far away from a surface of maximum fluid content may reduce fluid collection. Thus, in some embodiments, a the frame is disposed near a gas outlet such that one or more collection panels are disposed within 8 m (e.g., within 5 m or within 3 m) of a surface of maximum fluid content of gas exiting the gas outlet. In some embodiments, fluid collection is mostly or totally agnostic to the particular location of collection panel(s), for example where the fluid distribution throughout a gas stream is relatively uniform, such as in the middle of a duct.

In some embodiments, collection panel(s) are mounted on a motion stage so their location can be adapted, for example due to changes in a location of surface of maximum fluid content (e.g., in the case of strong winds or other ambient conditions). Referring back to FIG. 1B as an example, frame 105 is mounted on motion stage 140, which is attached to cooling tower 150. (Frame 105 can be considered as attached to cooling tower 150 through motion stage 140.) Motion stage 140 may be operable to move frame (e.g., up or down) in order to adjust a position of collectors 110 and/or emitters 120 based on changes in ambient conditions (e.g., temperature, pressure, or wind velocity). Motion stage 140 may adjust the position of collectors 110 and/or emitter electrodes 120 (e.g., independently) in order to enhance fluid collection after conditions have changed, for example. Motion stage 140 may have some range of associated motion such as, for example, a range of motion of no more than 20 m (e.g., no more than 10 m, no more than 5 m, or no more than 1 m). A motion stage may be automatically or manually operable. A motion stage may include one or more jack screws or one or more actuators (e.g., hydraulic, pneumatic, or electrical actuators). In some embodiments, a motion stage is operable to independently move different electrically conductive collectors and/or emitter electrodes (e.g., independently move subsets thereof that are attached to different frames). In some embodiments, a motion stage is operable to move while a plurality of electrically conductive collectors and a plurality of emitter electrodes remain in a fixed relative position.

In some embodiments, a species collection system includes one or more additional components. For example, species collection system 100 includes additional components 130*a-b*, shown in FIG. 1B. An additional component may be disposed a distance away from one or more collection panels (e.g., inside of a cooling tower). Examples of additional components are cooling mechanisms, humidifying mechanisms, and particle injectors. Additional components 130*a-b* are shown as being inside cooling tower 150, but in some embodiments, one or more additional components are physically disposed outside of cooling tower or duct (even if they operate to alter conditions inside the cooling tower or duct). Generally, although not necessarily, an additional component is disposed in a direction of gas flow of a gas stream before one or more collection panels, for example for reasons which will become clear in the following paragraphs.

A cooling mechanism may supply cooling, for example, through heat exchangers (e.g., external heat exchangers). In an example of a species collection system for a cooling tower, a cooling mechanism may be used when the ambient weather conditions are such as an additional cooling of the exiting air results in more fog production and thereby more water recovery during operation. Cooling can also be done directly on one or more collection electrodes of a collection panel, making the electrode(s) serve as both a collection site for already formed droplets and a condensation site for flowing vapor.

A humidifying mechanism may be used to promote fog production in order to improve fluid collection. In an example of a species collection system for a cooling tower, waste vapor from a plant cooled by the cooling tower (e.g., a power plant) can be used to humidify the tower outlet in order to encourage further fog production in order to increase fluid collection.

In some embodiments, a species collection system includes a particle injector. By injecting small particles that can act as condensation nuclei, a condensation rate is increased (e.g., by lowering the supersaturation needed for condensation is lowered). Using a particle injector may result in more fog formation. A particle injector may inject charged particles. A particle injector may inject particles of different sizes. For example, particles injected into a gas stream by a particle injector may have a multimodal size distribution. Particles injected by a particle injector may be pre-cooled (relative to an ambient temperature of a gas stream) before injection. Depending on the application and working conditions, these particles may or may not be filtered out after the fluid is collected at one or more collection panels, for example using an intermediate filter.

Figure 2A:
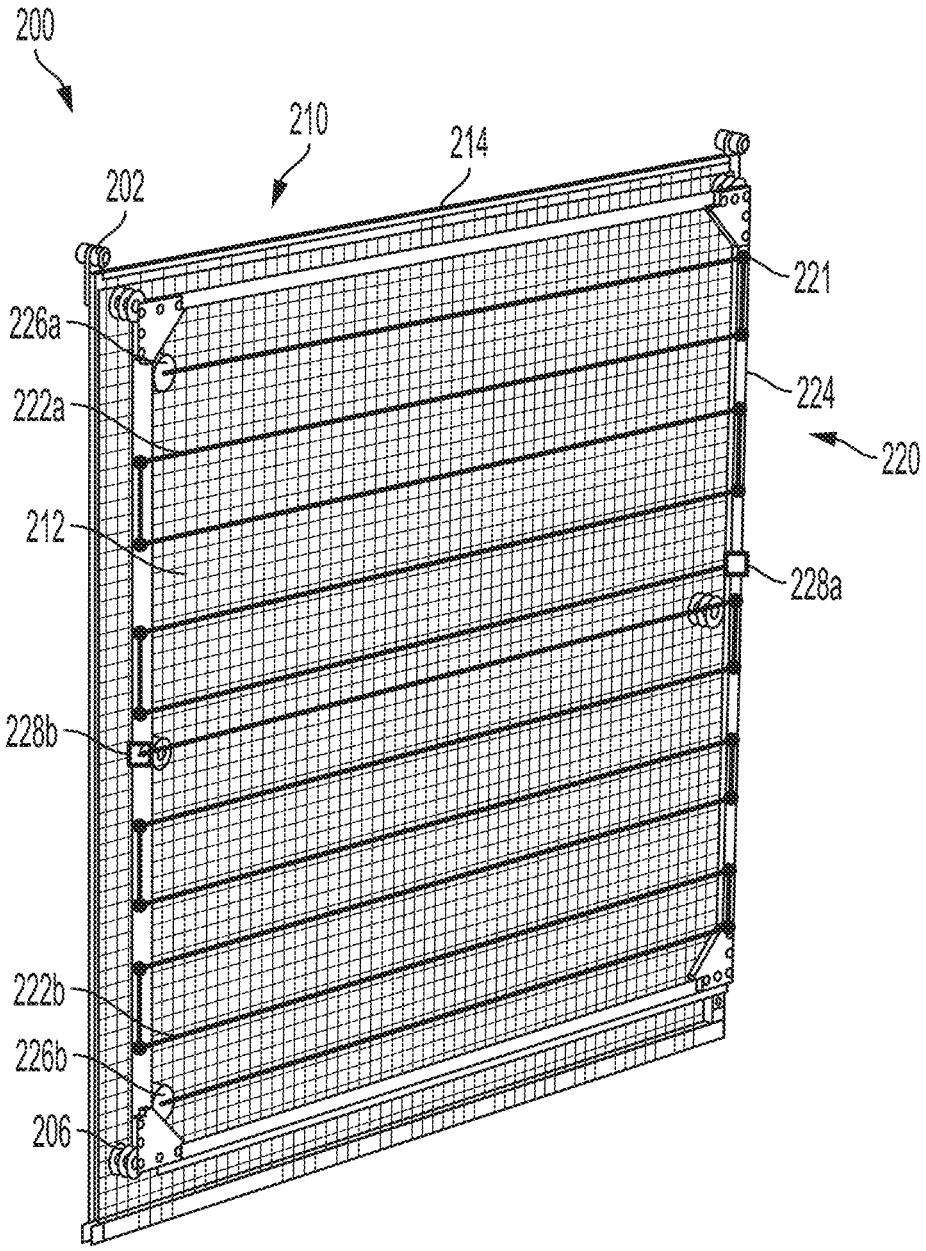
FIGS. 2A-2C show a panel including an electrically conductive collector and two emitter electrodes, according to illustrative embodiments of the present disclosure.
Figure 2C:
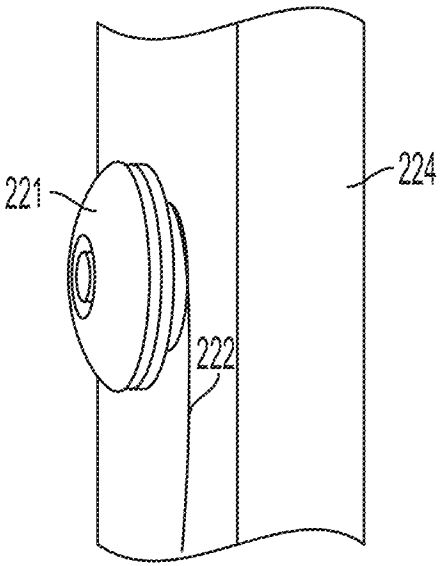
Figure 2B:
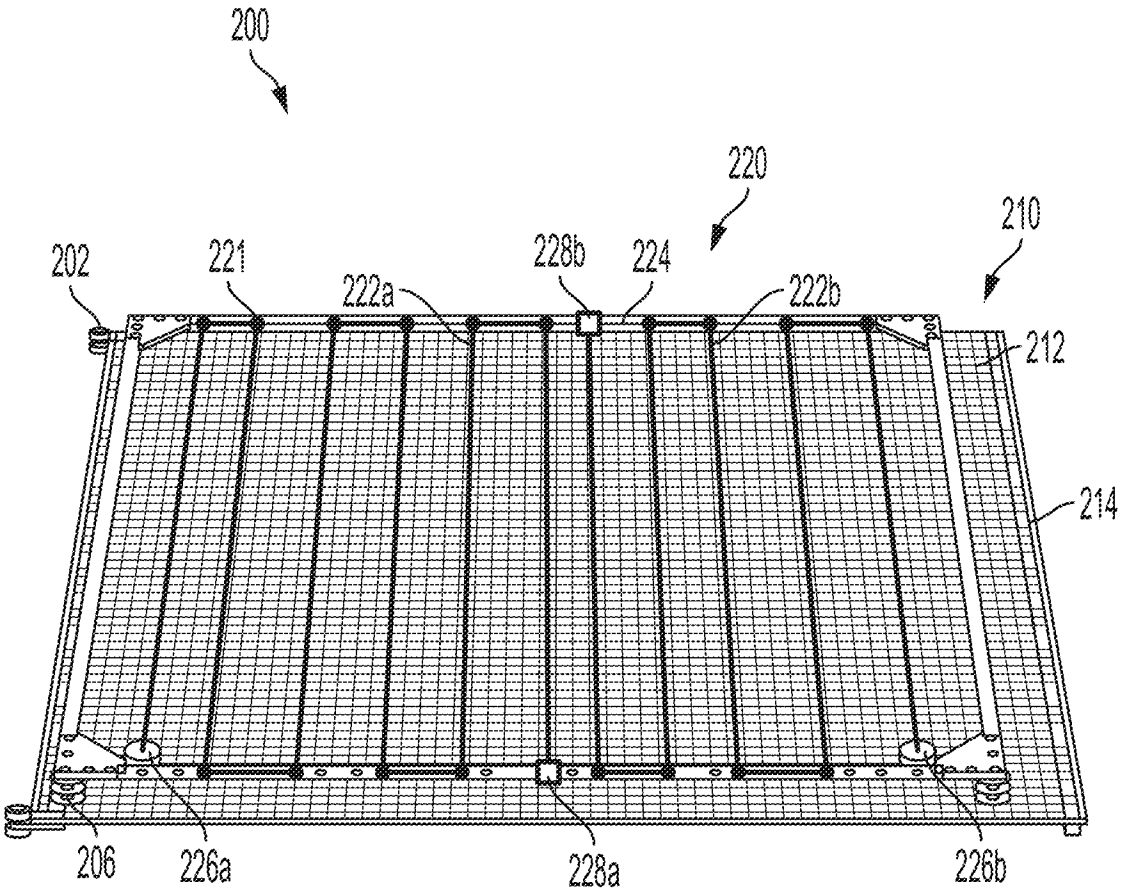

Collectors and emitter electrodes may be attached to (e.g., and electrically insulated from) each other in the form of collection panels. Multiple collection panels may be arranged in a spaced apart stack (e.g., aligned with a direction of gas flow from a gas outlet). Referring now to FIGS. 2A-2B, an example of a panel 200 for use in collecting one or more species from a gas stream is shown, for example for use in species collection system 100 shown in FIGS. 1A-1C. As shown in FIGS. 2A and 2B, panel 200 includes emitter electrode assembly member 220 and species collection member 210. Emitter electrode assembly member 220 includes metal wires 222*a-b* (which are emitter electrodes), emitter electrode frame 124, capstans 121, springs 126*a-b*, and wire connector studs 128*a-b*. Metal wire 222*a* may be of a different diameter than metal wire 222*b*. For example, a larger diameter wire serving as an emitter electrode may be located further from a gas outlet than a smaller diameter wire serving as an emitter electrode. As explained elsewhere, a larger diameter wire may be used to deflected charged species while a smaller wire is used to charge species (e.g., by generating ions via corona discharge) (and also deflect). Species collection member 210 includes electrically conductive mesh collector 112 (which is a collection electrode) attached to collection frame 114. Emitter electrode assembly member 220 is physically attached to and electrically insulating from species collection member 210, in this example using electrically insulating members 206. In this example, six electrically insulating members 206 are used. Electrically insulating members 206 are specifically attached to emitter electrode frame 224 and collection frame 214, but other connection locations may be used. Electrically conductive mesh collector 212 is physically separated from metal wires 222*a-b*, in this example by virtue of electrically insulating members 206. Collector 212 has a larger area than emitter electrode assembly member 220. Emitter electrode assembly member 220 is disposed within no more than 0.5 m of species collection member 210. Electrically conductive mesh collector 212 may be grounded, for example when panel 200 is installed in a collection system.

One or more emitter electrodes may include one or more wires. Wires used as emitter electrodes may be metallic. For example, a wire may include one or more of stainless steel, copper, aluminum, silver, gold, titanium, and tungsten. In some embodiments, a wire has a diameter from 50 μm to 10 mm. For example, a wire may have a diameter from 50 μm to 250 μm or from 100 μm to 200 μm. In some embodiments, a wire comprises 304 stainless steel. For example, a wire may be made from spring back (hardened) 304 stainless steel. In some embodiments, a wire has a tensile strength of at least 1 GPa. Without wishing to be bound by any particular theory, a wire with higher tensile strength may partially or completely mitigate wire-snapping failures from any source of wire deflection or wire vibration during operation of a panel. One or more emitter electrodes may be attached to an emitter electrode frame (for example as shown in FIGS. 1A-1B) under tension. One or more emitter electrodes may be wrapped around an emitter electrode frame, for example using one or more capstans (e.g., as discussed in subsequent paragraphs). In some embodiments, an emitter electrode is a needle (e.g., having a small radius of curvature). A panel may comprise an emitter electrode assembly member comprising a one- or two-dimensional array of needles (e.g., disposed perpendicular to the collector). In some embodiments, a panel is operable to maintain a voltage of at least 1 kV, and optionally no more than 500 kV, at one or more emitter electrodes. For example, a panel may be operable to maintain a voltage of at least 25 kV, at least 50 kV, or at least 100 kV (e.g., and no more than 250 kV) at one or more emitter electrodes.

One or more collection electrodes may include an electrically conductive collector. A collector may be, for example, an electrically conductive mesh or porous surface. A collector may comprise metal, such as stainless steel for example. A mesh may be made of large gauge metal wires for example. As another example, a collector may be a porous metal plate. A collector may be planar. One or more collection electrodes may be disposed in a planar arrangement. In some embodiments, a collector has a low contact angle hysteresis (e.g., of no more than 40 degrees difference between a receding contact angle and an advancing contact angle, e.g., when a panel is disposed at an angle of from 30 degrees to 60 degrees relative to level ground). Low contact angle hysteresis may help in shedding water during species collection.

Referring again to FIGS. 2A-2B, wires 222*a-b* are wrapped around emitter electrode frame 224 using capstans 221 and held on one end by wire connector studs 228*a-b* and on the other end by springs 226*a-b*. Emitter electrode frame 224 is electrically insulating. For example, emitter electrode frame may be made from fiberglass reinforced plastic (thereby having a relatively high rigidity while also being electrically insulating). An electrically insulating emitter electrode frame may avoid or reduce additional discharge and ion generation from the emitter electrode frame during operation. Wires 222*a-b* are under tension along their lengths. For example, wires 222*a-b* may be entirely under at least 0.5 N and not more than 25 N of tension, for example along their entire length. In some embodiments, emitter electrode(s) are each entirely under at least 6 N and not more than 8 N of tension. Springs 226*a-b* are constant force springs. Constant force springs may be used to produce more uniform tension and emitter electrode(s) may therefore have more uniform properties (e.g., electrical properties) across the area of a panel. Wires 222*a-b* are wound around (e.g., less than one full rotation around) capstans 221, which are spaced apart on emitter electrode frame 224, in order to space them across a collection area. Capstans 221 are low friction, thereby negligibly influencing impacting the tension of wires 222*a-b* as they are wrapped. FIG. 2C shows a close up of one of wires 222 wrapped around one of capstans 221, which is attached to emitter electrode frame 224. In some embodiments, each emitter electrode is wound around at least three capstans.

Figure 3B:
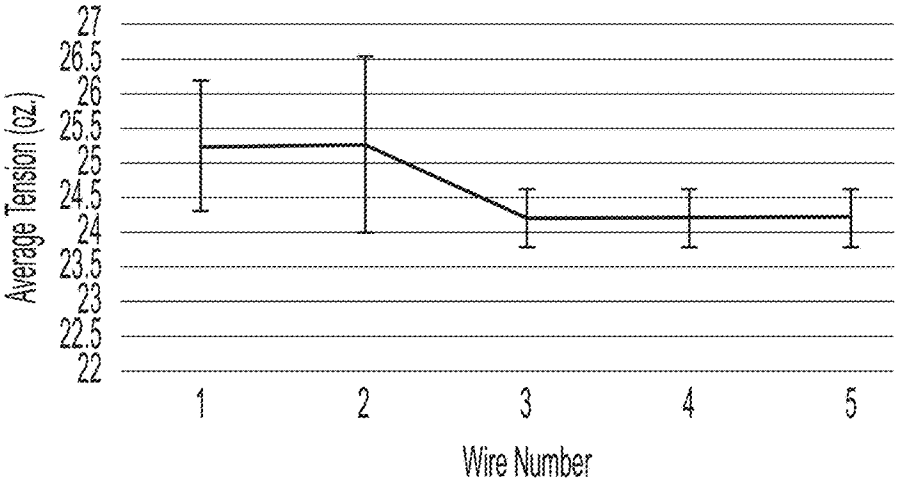
FIGS. 3A-3B show emitter electrodes attached to a frame under tension, according to illustrative embodiments of the present disclosure.
Figure 3A:
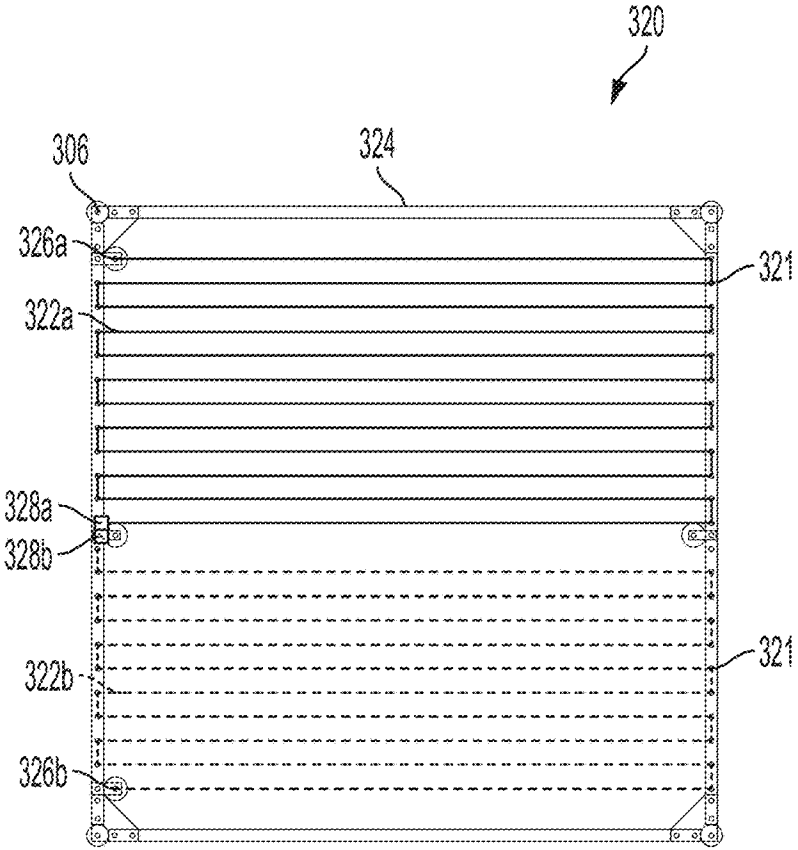

An additional example of wire emitter electrodes disposed on an emitter electrode frame is shown in FIG. 3A. FIG. 3A is a schematic of an example of a emitter electrode assembly member 320. Emitter electrode assembly member 320 includes emitter electrode frame 324, emitter electrodes 322*a-b* (which are metal wires), constant force springs 326*a-b*, capstans 321, and wire connector studs 328*a-b*. Electrically insulating members 306 are attached to emitter electrode frame 324. One end of emitter electrode 322*a* is fixed (in this example to electrode frame 324) at wire connector stud 328*a*. Emitter electrode 322*a* is wound around a plurality of capstans 321 and the other end is attached to constant force spring 326*a*, which is itself attached to electrode frame 324. One end of emitter electrode 322*b* is fixed (in this example to electrode frame 324) at wire connector stud 328*b*. Emitter electrode 322*b* is wound around a plurality of capstans 321 and the other end is attached to constant force spring 326*b*, which is itself attached to electrode frame 324. By using constant force springs 326*a-b*, emitter electrodes 322*a-b* are kept at constant tension. Capstans 321 are plastic (e.g., PTFE) cylinders with low friction. Capstans 321 are disposed up and down opposite sides of emitter electrode frame 324.

In some embodiments, it is preferable to use wires as emitter electrodes and, particularly in some embodiments, wires that are kept at a constant tension. Deformations of wires may thus be low under regular loads (e.g., ambient wind or vibration from a cooling tower). Moreover, risk of breaking may be low due to elasticity of the wire. In some applications, upon impact with a rain droplet or other object, a wire can deform and come back to its original tension (e.g., in part due to constant force springs, if present). By using capstans (e.g., small plastic cylinders, for example with a low friction coefficient), a wire can wind (partially) around them, thereby achieving a desirable spacing, and only have a minor effect on tension. A preferred number of capstans per wire can be determined so that the tension in all parts of the wire is within an acceptable range. FIG. 3B is a graph showing experimental results for wire tension. As can be seen from FIG. 3B, average wire tension stabilizes after the wire has been wound around only a small number of capstans, in this case on a ~1.5 m panel. (Wire number refers to the number of passes from side to side of the panel, for example as shown in FIG. 3A, so that a wire number of 2 corresponds to a wire that is roughly twice as long as a wire number of 1.)

Additional collection panels and components thereof, including emitter electrodes and collectors (e.g., collection electrodes), that may be used in systems and methods disclosed herein are described in U.S. Provisional Patent Application No. 62/881,814, filed on Aug. 1, 2019, and U.S. Provisional Patent Application No. 62/881,691, filed Aug. 1, 2019, the disclosures of each of which are hereby incorporated by reference herein in their entirety. Methods of using emitter electrodes and electrically conductive collectors to collect species from a gas stream that are applicable to systems and methods disclosed herein are described in U.S. patent application Ser. No. 15/763,229, filed on Mar. 26, 2018, the content of which is hereby incorporated by reference in its entirety.

For optimal performance of a species collection system, the distance between emitters and collectors should be kept as substantially constant (e.g., varying no more than 5%). Spacing can be well maintained in part by maintaining collectors as straight as possible. In some embodiments, a collector mesh is affixed to a more rigid metal edging or frame on the sides and is kept under tension. For example, one or more springs can apply tension to a metal edging attached to a collector. A tensioning system may apply tension force to a rigid edging in order to achieve a more uniform transfer of force to the collector. Tensioning can be done using springs or turnbuckles, for example. Pre-tensioning a mesh collector can reduce potential deflections of the mesh due to wind or vibrations while maintaining emitter to collector separation.

In some embodiments, rigidifying members (e.g., rods) are added along the length of a collector to increase rigidity of the collector. In some embodiments, one or more tensioning cables (e.g., metal cables) are run through a collector (e.g., through openings of a mesh collector). Tensioning cable(s) may be attached to a rigid frame or edging such that they tension a mesh collector thereby straightening it. Additionally an edging/frame for a collector may be specifically designed to house tensioning cable(s) so that the weaving it through the edge/frame could be done easily (e.g., by running the tensioning cable(s) over one or more capstans). The edge/frame would be fixed to the mesh collector uniformly so that when the cable is pulled in tension it applies the tension force to the entirety of the mesh as a well distributed force.

In some embodiments, emitter electrodes are maintained at a high voltage (e.g., between 1 kV and 500 kV) and are therefore preferably electrically insulated from collectors. Electrically conductive collectors may be grounded. For a species collection system that includes one or more emitter electrodes operable to be maintained at high voltage and one or more collectors that are grounded, the one or more emitters can be attached directly to the one or more collectors via high-voltage insulators (e.g., as in collection panel 200 in FIGS. 2A-2C). In some embodiments, at least some (e.g., all) emitter electrodes are attached to an emitter frame that is physically connected to and electrically insulated from a collector frame to which one or more collectors are attached via one or more insulating members (e.g., as shown in FIGS. 4A-4B, 5A-5C). Because insulator dimensions are commonly less restrictive in the second case, larger length insulators can be used, including off the shelf ceramic or polymer insulators can be used. In some embodiments, an entire emitter frame would be held at a common (e.g., single) voltage, when all components are electrically conductive and connected to a power supply. The insulating member(s) that attach an emitter frame to a collector frame may be disposed in respective housings to further isolate them from the environment, thereby possibly slowing degradation (e.g., due to pollutants and/or soiling) that would reduce electrical insulation performance. In some embodiments, one or more emitter electrodes are maintained at a voltage of at least 1 kV and, optionally, no more than 500 kV [e.g., a voltage of at least 5 kV at least 10 kV, at least 15 kV, at least 25 kV, at least 50 kV, at least 100 kV) (e.g., and no more than 250 kV, no more than 100 kV, or no more than 50 kV)].

Figure 4B:
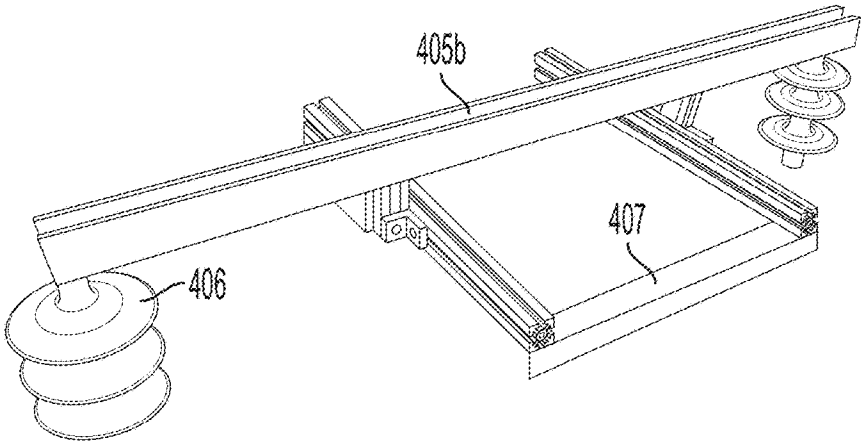
FIGS. 4A-4B show an arrangement of species collection system, according to illustrative embodiments of the present disclosure.
Figure 4A:
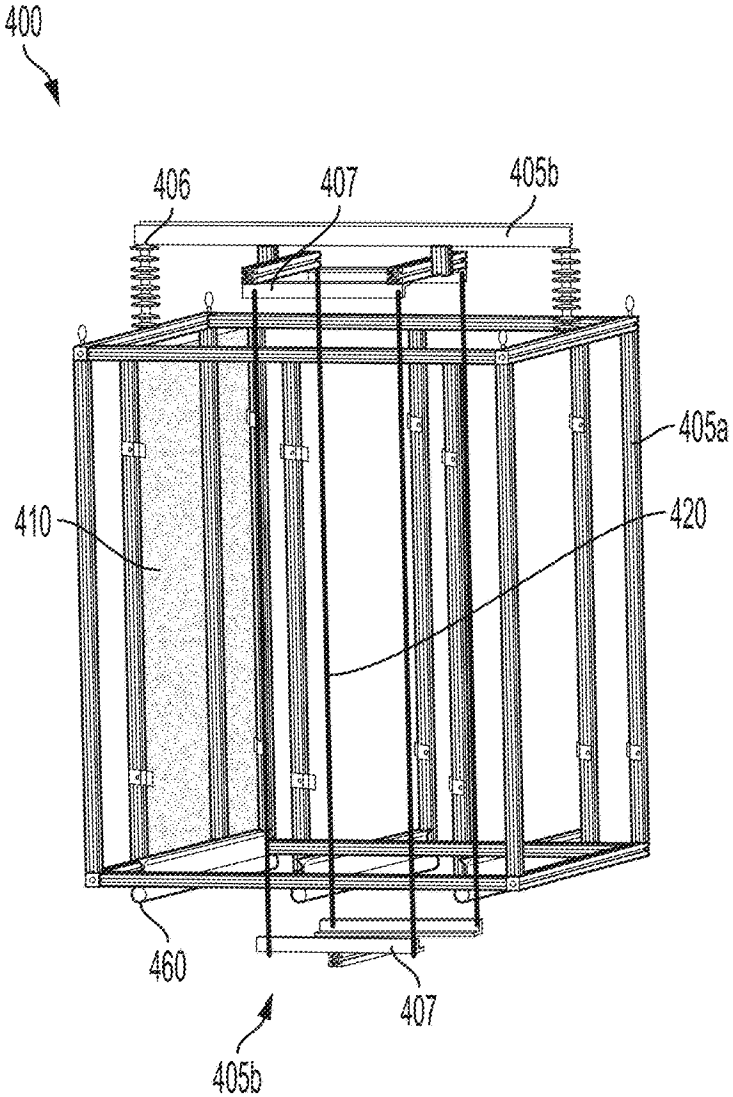

FIGS. 4A and 4B show a species collection system 400. Species collection system includes emitter frames 405*b*, which include electrically conductive elongated emitter connection members 407. Emitter electrodes 420 are attached to emitter connection members 407. Top emitter frame 405*b* is attached to and electrically insulated from collector frame 405*a* by electrically insulating members 406. (In some embodiments, emitter frames 405*b* and collector frame 405*a* are collectively referred to as a frame.) Emitter electrodes 420 are disposed between collectors 410 and extend beyond collectors 410 in one dimension. For each pair of adjacent collectors 410, two of emitter electrodes 420 are disposed between the collectors 410. Collectors 410 may be metal plates. Species collection system 400 may be oriented when installed so that gas flows perpendicular or parallel to emitter electrodes 420. Gutters 460 are attached to collectors 410 and are used to collect species collected on collectors 410 and drained therefrom. FIG. 4B shows a detail of electrically insulating member 406, emitter frame 405*b*, and electrically conductive elongated emitter connection members 407.

Emitter electrodes may be attached to an emitter frame and collectors may be attached to a collector frame. An emitter frame and/or collector frame may be metallic. Thus, a subset (e.g., all) of the emitter electrodes in a system may be commonly electrically connected. A subset (e.g., all) of the collectors in a system may be commonly electrically grounded. An emitter frame may include one or more electrically conductive elongated emitter connection members (e.g., metal rod(s)) to which emitter electrodes can be commonly attached (e.g., wrapped at least partially around), even when different ones are disposed between different pairs of collectors, thereby simplifying wiring to the emitter system. The space between emitter electrodes and collectors can therefore be set simply by how the emitter electrodes are attached to emitter connection members and how an emitter frame is fixed relative to collectors, rather than the length or dimensions of insulating members (e.g., as in the case of collection panel 200 shown in FIGS. 2A-2C). This allows use of insulators of arbitrary length, while the emitter-to-collector spacing is set purely by where the emitters are mounted onto emitter connection members. Thus, longer insulators, such as off-the-shelf insulators, can be used, thereby simplifying overall design.

Figure 5B:
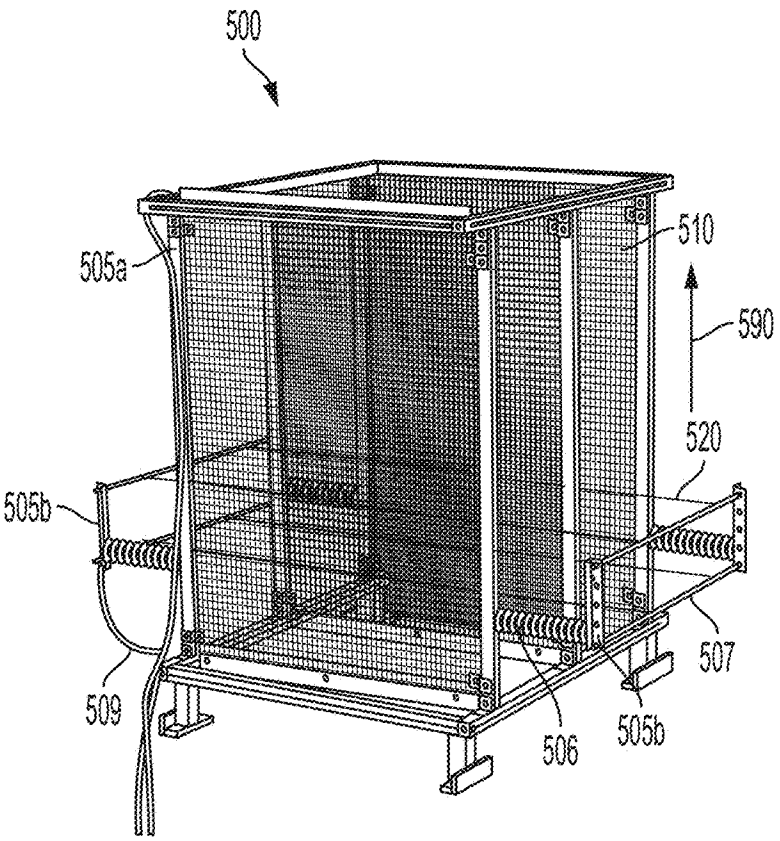
FIGS. 5A-5C show examples of a species collection system, according to illustrative embodiments of the present disclosure.
Figure 5A:
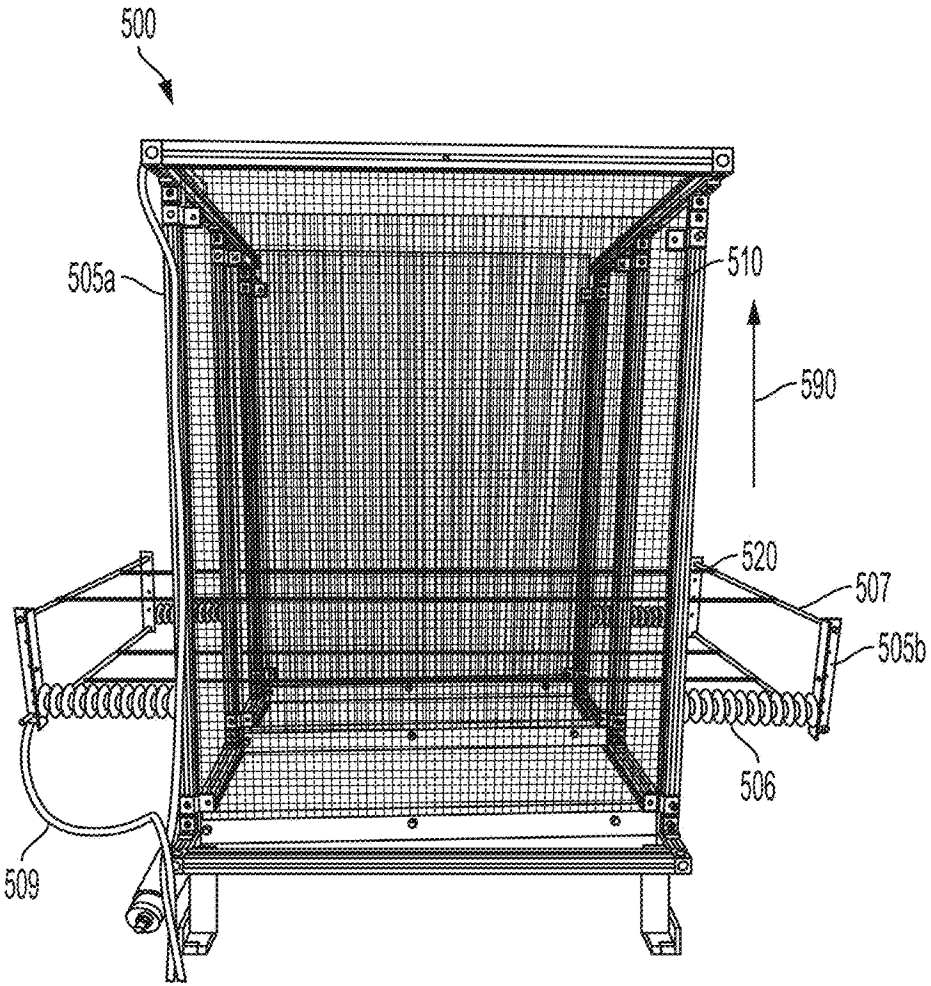
Figure 5C:
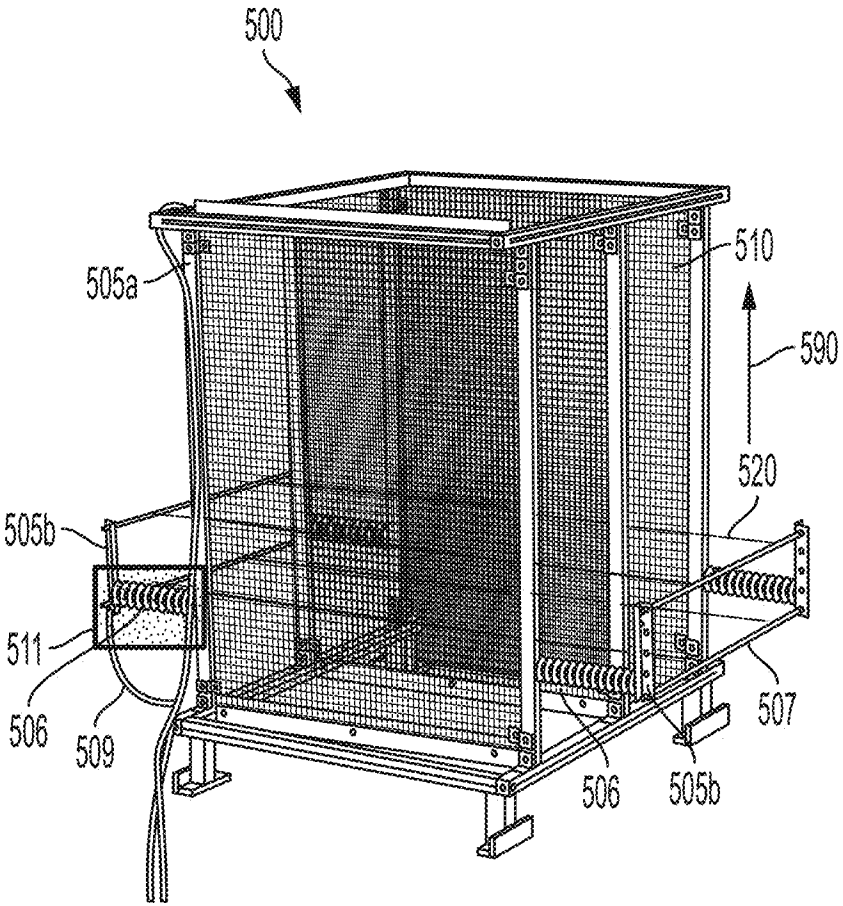

FIGS. 5A-5C show configurations of species collection system 500. Species collection system includes emitter electrodes 520 (that are wires), electrically conductive collectors 510 (that are wire meshes), and a frame (comprised of collector frame 505*a* and emitter frames 505*b*). Emitter frames 505*b* are attached to and electrically insulated from collector frame 505*a* by electrically insulating members 506. Collectors 510 are held under tension in collector frame 505*a*. Emitter frames 505*b* are side mounted to collector frame 505*a*. Species collection system 500 can be disposed such that emitter frames 505*b* and electrically insulating members 506 are outside of a periphery of a gas outlet (e.g., collectors 510 may span a gas outlet). Emitter frames 505*b* include electrically conductive elongated emitter connection members 507 (in this example metal rods) to which emitter electrodes 520 are attached (e.g., wrapped at least partially around). Tension on emitter electrodes 620 may be controlled, for example, by how tightly they are wrapped around emitter connection members 507. Different emitter connection members 507 are at different heights (and evenly spaced). Only two are shown, but more may be included. Emitter electrodes 520 are evenly spaced (and disposed between different pairs of adjacent collectors 510) due to their positioning on emitter connection members 507. Emitter electrodes 520 extend beyond collectors 510 in one dimension (perpendicular to direction 590 of gas flow). Collectors 510 have a high aspect ratio of greater than 1 in direction 590 of gas flow. Voltage can be applied to emitter electrodes 520 through power supply 509.

Soiling and degradation of insulating members (e.g., that connect an emitter frame to a collector frame) can occur over time if constantly exposed to a plume (e.g., owing to the water as well as possibly dissolved contaminants in the water that would deposit on the surface over time). Side mounting emitter electrodes outside of collectors (e.g., using emitter frames) may place insulating members also outside of collectors, for example if collectors span a gas outlet. Keeping insulating members outside of a plume can reduce degradation and/or increase time to reach a detrimental level of degradation. To further slow and/or reduce degradation of insulating members, they can be arranged in a housing (e.g., a respective housing). FIG. 5C shows an example of an insulating member 506 that is disposed in a respective housing 511, which may environmentally isolate it. The sheds and surface of insulating member 506 would have at least reduced exposure to the ambient and while allowing insulating member 506 to electrically insulate (e.g., isolate) emitter electrodes 520 and emitter connection members 507 from collectors 510 and collector frame 505*a*, which are electrically grounded. In some embodiments, a housing is shaped to accommodate emitter connection members to pass in and out of it without electrically shorting (e.g., using safe-clearances and high-voltage insulation). A housing for an insulating member may be made out of an electrically conductive material (e.g., metal) or an electrically insulating material (e.g., fiberglass or garolite), for example depending on the dimensions of the design.

A power supply may be used to apply a voltage to emitters, while the collectors are connected to electrical ground. This configuration creates an electric field between the emitters and the collectors. Voltage applied to one or more emitter electrodes can be optimized to enhance collection over small areas and to minimize power consumption. Typical (but non-limiting) values for the strength of the electric field generated between emitter electrodes and collectors are 2-20 kV/inch.

In some embodiments, voltage applied to different emitter electrodes (e.g., different emitter electrodes that are positioned between the same pair of adjacent collectors) can be different. Voltage of emitter electrodes may be set based on a distance the emitter electrode is from a gas outlet. For example, all emitter electrodes within a first distance may be maintained at a first voltage and all emitter electrodes further than a first distance, but within a second distance, may be maintained at a second voltage. The second voltage may be lower than the first voltage. A system may thus be effectively divided into sections or slices and each section has its emitters at a certain voltage. Such arrangements allow for more efficient power usage. Moreover, different emitter geometries may be used in different sections to further optimize performance. For example, lower curvature (larger diameter) wires may be used as emitter electrodes in sections further from a gas outlet and higher curvature (smaller diameter) wires may be used as emitter electrodes in sections closer to the gas outlet.

Keeping power consumption low is desirable for a system to be economically viable and attractive. As an example, corona discharge consumes power by establishing a flow of ions from emitter electrodes to collectors. Hence, operating an emitter electrode at an optimum production rate of ions to minimally fully charge all species (e.g., water droplets) in a gas stream (e.g., plume) allows minimal current to be used, thereby minimizing energy consumption. A multi-stage design can help in this effort by splitting the collection process into separate charging and deflection stages. Corona discharge is only useful for the charging stage, and once species are charged, ordinary electrostatic fields can be used to deflect charged species without adding additional current and thus power consumption. Therefore, while additional conductive members (e.g., emitter electrodes) are desirable to include between collectors in order to provide additional charged species deflection, thereby enhancing species collection, it is not necessary for all such conductive members to be operated at a sufficient voltage to generate ions. Thus, in some embodiments, a lower voltage in the second stage or section (and thus less current) is used. Additionally or alternatively, different conductive member(s) that are less prone to generating current (such as plates or larger diameter rods or wires) may be disposed further along a path of gas flow from a gas outlet than emitter electrode(s) that are maintained at a relative higher voltage.

Figure 6B:
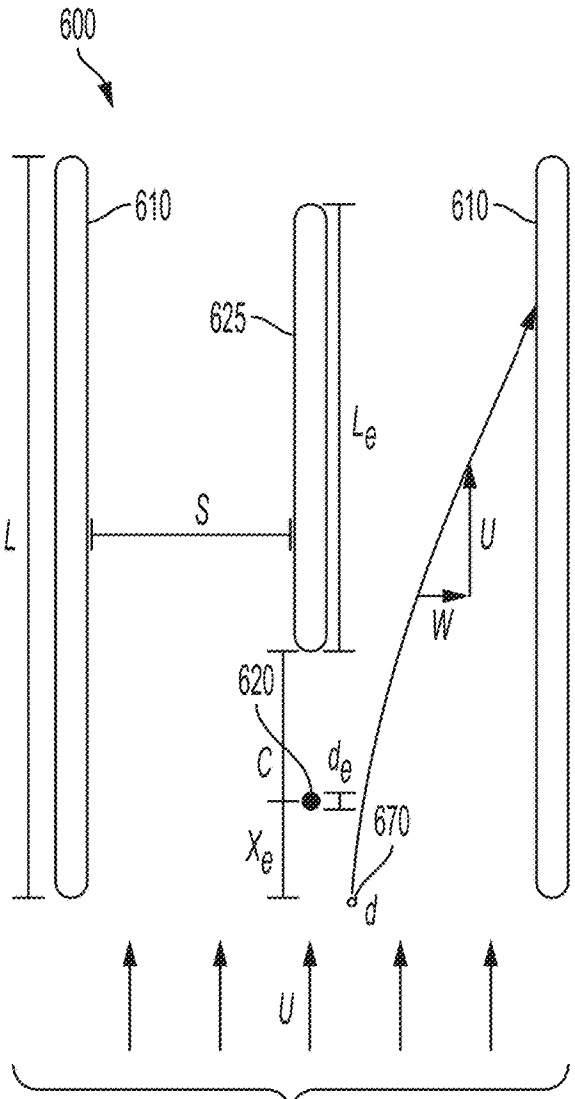
FIGS. 6A and 6B illustrate collection of a water droplet from a gas stream using species collection systems, according to illustrative embodiments of the present disclosure.
Figure 6A:
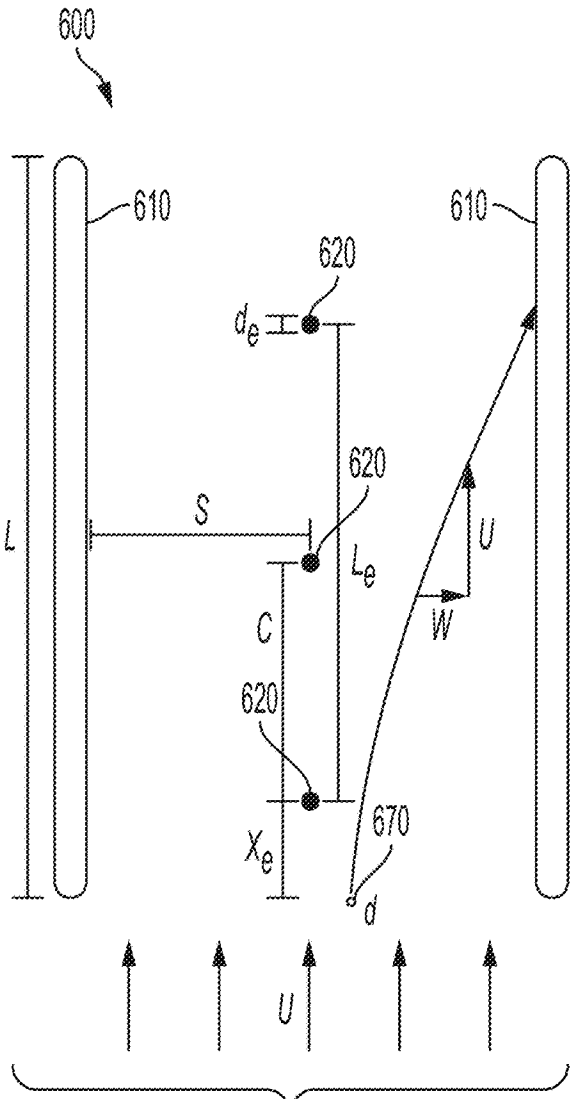

FIGS. 6A-6B show different arrangements of a portion of a species collection system 600. Referring to FIG. 6A, multiple emitter electrodes 620 are disposed between adjacent collectors 610. Emitter electrodes 620 are rods or wires that are tensioned perpendicular to a direction of gas flow U. Emitter electrodes 620 are evenly spaced in a direction perpendicular to a direction in which collectors 610 are spaced. Collectors 610 may be an electrically conductive mesh or plate, for example. Emitter electrodes 620 are shown as being a constant size, but may be different sizes, for example emitter electrode 620 that is furthest from may be larger. Larger diameter emitter electrodes may be less likely to generate currents and therefore may be more power efficient. Alternatively or additionally, a smaller voltage may be applied to emitter electrodes 620 further from a gas outlet (e.g., of a cooling tower) from which the gas flow U originates. Even if diameter is larger and/or voltage is smaller, an electric field will still be generated that will deflect species 670 (e.g., water droplets) toward collectors 610. A trajectory of species 670 is shown. The proximal emitter electrode 620 may have a sufficient voltage applied to it as to charge species 670 and any other species 670 present as they flow by.

Referring to FIG. 6B, in a configuration of species collection system 600, a single emitter electrode 620 and an electrically conductive (e.g., metal) plate 625 is disposed between collectors 610. Emitter electrode 620 is a rod or wire that is tensioned perpendicular to a direction of gas flow U. Collectors 610 may be an electrically conductive mesh or plate, for example. Plate 625 and emitter electrode 620 are in a common plane. Emitter electrode 620 is proximal to a gas outlet (e.g., of a cooling tower) from which gas flow U originates and plate 625 is distal. Emitter electrode 620 may be maintained at a voltage sufficient to charge passing species (e.g., water) (e.g., at least 1 kV). Plate 625 may be maintained at a voltage that is less than that at which emitter electrode 620 is maintained. The voltage at which plate 625 is maintained may be insufficient to charge any passing species (e.g., to generate ions), but still sufficient to generate an electric field that deflects species 670. In some embodiments, between some pairs of adjacent collectors in a species collection system are multiple emitter electrodes and between some other pairs of adjacent collectors in the system are a plate and at least one emitter electrode.

In some embodiments, a gutter is disposed at a bottom of a collector (e.g., each of a plurality of collectors). A gutter may be attached to a collector. A gutter may include a channel placed around the bottom of the collector. Collected species (e.g., water) drain down a collector due to gravity and fall into the gutter. A gutter may be angled downward (e.g., relative to level ground) to more readily allow its contents to flow toward a periphery of a system. A gutter may be connected to collection conduit (e.g., a tube or pipe), for example at a periphery a system, to transfer the collected species. A gutter may be common to several collectors or each collector may have its own respective gutter. An edge of an electrically conductive collector may be disposed in a gutter. For example, the gutter may be attached to two opposing surfaces of the collector. A gutter may include one or more collection wings, for example to direct collected fluid down into the gutter. A gutter may include a tubular member into which fluid can drain. A gutter with collection wings may be shaped such that when droplets shed down a collector (e.g., a mesh), they are funneled into the gutter rather than hitting the collector-gutter interface and redirecting outwards and drip off of the system.

Figure 7B:
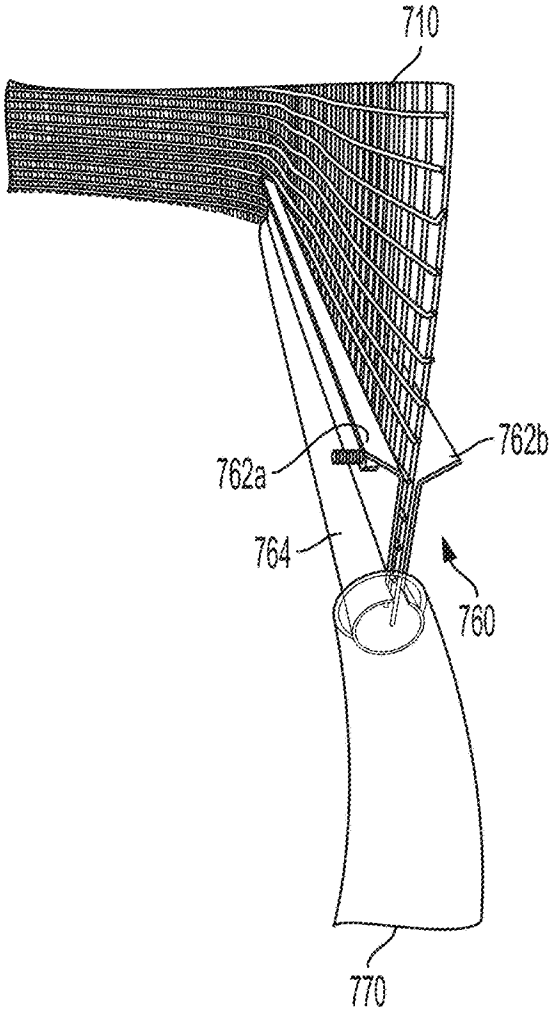
FIGS. 7A-7B show a gutter that can be used in a species collection system, according to illustrative embodiments of the present disclosure.
Figure 7A:
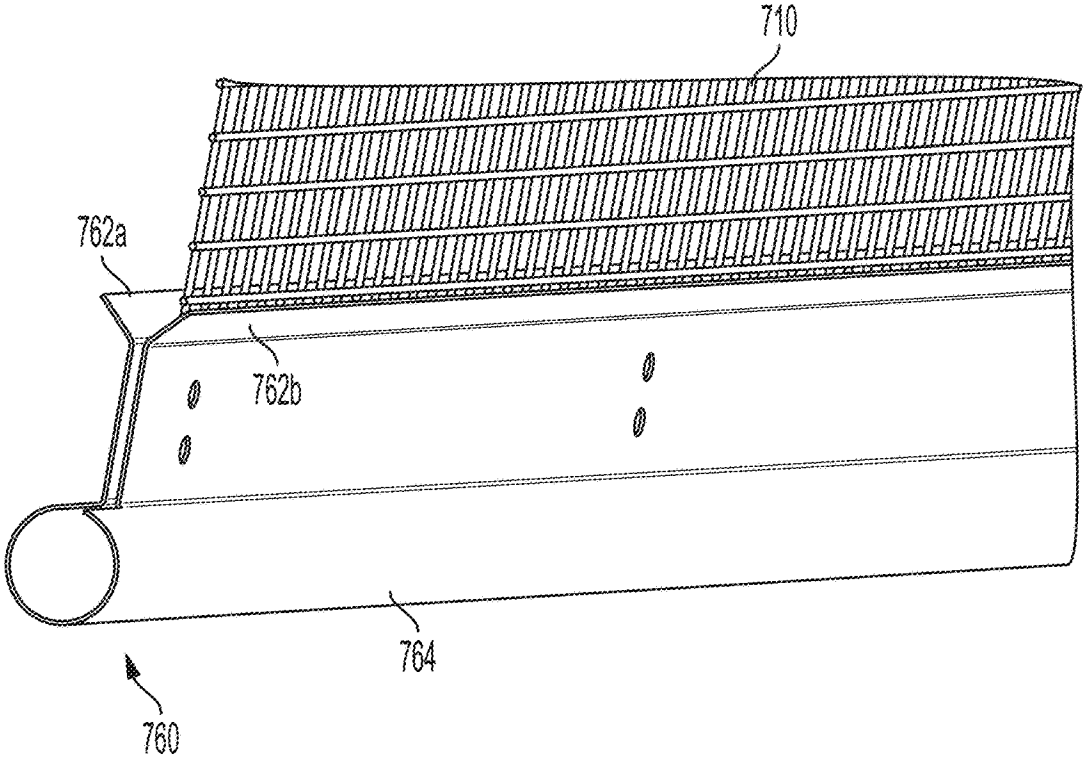
Figure 8:
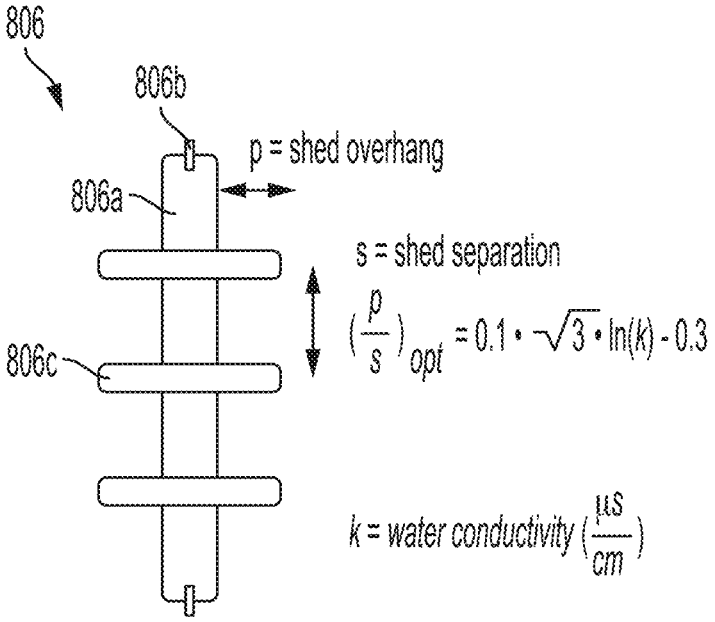
FIG. 8 shows an insulating member that may be used to electrically insulate emitter electrodes from electrically conductive collectors (e.g., in a panel or using emitter and collector frames), according to illustrative embodiments of the present disclosure.

FIGS. 7A-7B show details of gutter 760 attached to electrically conductive collector 710. Electrically conductive collector 710 is a wire mesh. Gutter 760 includes collection wings 762*a-b* and tubular member 764. Tubular member 764 has a circular cross section, but tubular members with other cross sections can also be used, such as tubular members with rectangular or triangular cross section. In the photograph of FIG. 7B, gutter 760 is in fluid communication with fluid conduit 770 that can be used to drain collected fluid towards a periphery of a system.

Figure 9C:
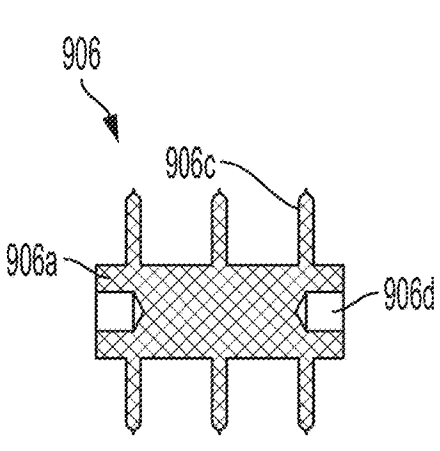
FIGS. 9A-9E show views of an insulating member, according to illustrative embodiments of the present disclosure.
Figure 9B:
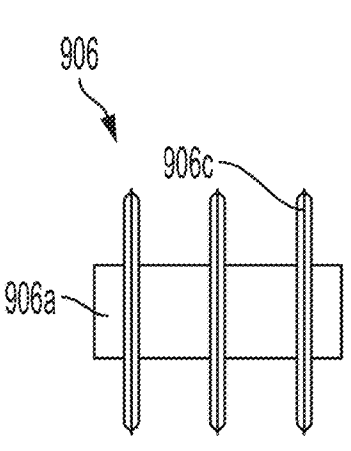
Figure 9A:
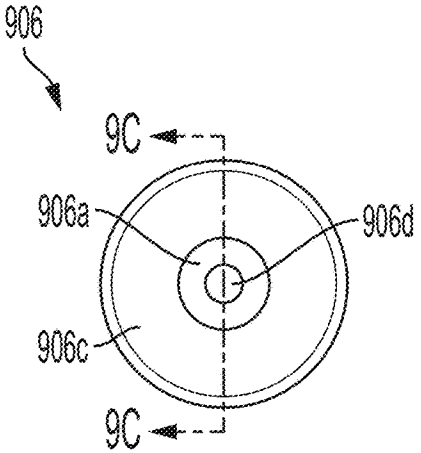
Figure 9E:
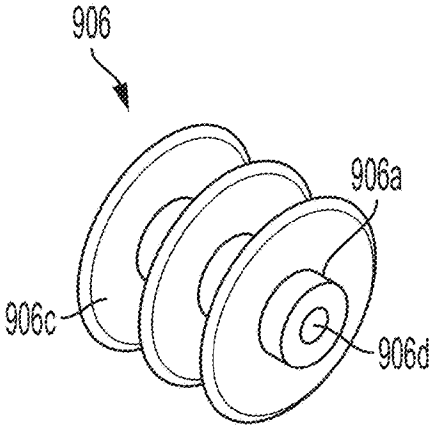
Figure 9D:
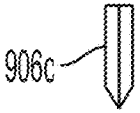

A panel may include one or more electrically insulating members. FIGS. 8 and 9A-9E are schematics of electrically insulating member 806 and electrically insulating member 906, respectively. Electrically insulating members 806, 906 are designed to withstand operating voltages under wet-conditions, for example in presence of fog for extended periods of time, or constant rainfall. Electrically insulating member 806 includes central core 806*a* and sheds 806*c*. Electrically insulating member 806 can be physically connected to a emitter electrode assembly member and/or a species collection member using fasteners 806*b* (e.g., screws or bolts). Fasteners 806*b* may be electrically conductive, but since central core 806*a* is electrically insulating, do not provide a conductive pathway through electrically insulating member 806. Electrically insulating member 906 includes central core 906*a* and sheds 906*c*. Sheds 906*c* have a 60° knife edge, as shown in FIGS. 9B, 9C, and 9D for example. Electrically insulating member 906 includes holes 906*d* (e.g., threaded holes 906*d*) for physically connecting to a emitter electrode assembly member and/or a species collection member using fasteners (not shown). In some embodiment, a species collection member is physically connected to an emitter electrode assembly member using one or more electrically insulating members (e.g., at least four or at least six electrically insulating members). Insulating members, such as insulating members 806, 906, may be used to attached emitter frames to collector frames (e.g., as in FIGS. 5A-5C) and such insulating members may have longer dimensions and/or additional sheds.

In some embodiments, insulator material, shed geometry and overall dimensions of an electrically insulating member are selected to optimize the electrically insulating member's resistance to shorting in wet conditions. An electrically insulating member may have a dielectric strength of at least 200 kV/cm (e.g., at least 400 kV/cm). An electrically insulating member may have a surface energy of no more than 25 mN/m. In some embodiments, sheds are utilized to breakup surface conduction pathways from end-to-end of an electrically insulating member and to prevent from surface arcing or surface electrical breakdown. An electrically insulating member may include polytetrafluoroethylene (PTFE). In some embodiments, an electrically insulating member comprises a polytetrafluoroethylene (PTFE) cylinder. PTFE has useful dielectric properties (a dielectric strength about 600 kV/cm) and is hydrophobic (having a surface energy of about 20 mN/m). The hydrophobicity of PTFE facilitates effective drainage of water during a wetting event and may prevent arcing due to stagnant water patches along a surface of an electrically insulating member. An electrically insulating member may be cylindrical (e.g., having a cylindrical volumetric extent).

In some embodiments, an electrically insulating member includes one or more sheds, for example three sheds. In some embodiments, shed(s) have a particular radius relative to a central core. The difference between these two values is known as the "shed overhang" dimension of an electrically insulating member. Sheds may have the same or different overhangs in a given electrically insulating member. In some embodiments, nearby sheds are spaced apart by a certain dimension that evenly spaces the sheds along a central core setting a pitch or shed separation between adjacent sheds. A ratio of shed overhang to shed pitch may be kept above a certain optimal ratio based on empirical data that correlates the optimal ratio as a function of the conductivity of a fluid (e.g., water) the electrically conductive member is being sprayed with or exposed to. This ratio increases as the fluid draining along the electrically conductive member increases in conductivity. An overall length of an electrically conductive member may be dictated by a pre-determined (e.g., optimal) spacing between emitter electrodes and fluid collection electrodes.

In some embodiments, each of one or more sheds of an electrically insulating member comprises a knife edge (e.g., an about 600 knife edge). A knife edge may facilitate droplets draining effectively from each shed and avoid any pooling on a bottom edge of the shed.

In some embodiments, the fluid collection member and the emitter electrode assembly member are physically connected using one or more electrically insulating members (e.g., at least four or at least six electrically insulating members). The one or more electrically insulating members may have a dielectric strength of at least 200 kV/cm (e.g., at least 400 kV/cm). The one or more electrically insulating members may have a surface energy of no more than 25 mN/m. Each of the one or more electrically insulating members may comprise polytetrafluoroethylene (PTFE). Each of the one or more electrically insulating members may comprise one or more sheds. Each of the one or more electrically insulating members may comprise three sheds. In some embodiments, the one or more sheds overhang a central core of the electrically insulating member by a distance from 10 mm to 20 mm. In some embodiments, each of the one or more sheds is separated from each adjacent shed by a distance of from 10 mm to 30 mm. The distance may be from 17.5 mm to 22.5 mm. Each of the one or more sheds may have a thickness of from 2 mm to 3 mm. In some embodiments, each of the one or more sheds comprises a knife edge (e.g., an about 600 knife edge). Each of the one or more electrically insulating members may be cylindrical. In some embodiments, each of the one or more electrically insulating members has a longitudinal length and the longitudinal length may be from 25 mm to 150 mm, for example from 25 mm to 75 mm.

In some embodiments, collected fluid can be fed into a cold-water return (e.g., of a cooling tower), a hot water line, a basin of a cooling tower, a location at a facility, or into a water distribution system (e.g., a municipal water system). This can be done by directly feeding collected amounts of fluid down toward the relevant line, or toward a separate tank, which then feeds into the desired return, line, basin, facility or system. In some embodiments, water can be used in other parts of a plant (e.g., power plant) or sold separately.

Depending on ambient conditions and quality of collected fluid, an intermediate filtering step can be used to purify collected fluid to a certain standard (e.g., a condenser coolant water quality standard), which may depend on location and facility a species collection system. Filtration may be preferred if a particle injector is used to enhance condensation rate of gas in a gas stream.

Fluid used for cooling may be, for example, water such as brackish water or seawater. Collecting fluid from a gas stream may have an added benefit of desalinizing water while also abating plume. That is, seawater may be used, for example for cooling, and pure, unsalinated water may be collected using a system described herein. In some embodiments, the system is combined with a cooling tower using seawater or other brackish water as feedwater, resulting in an ultra-low cost desalination system. A coastal power plant may use seawater in a cooling tower and an installed species collection system can then collect pure water coming out of the cooling tower, which can be used for domestic, industrial or agricultural needs.

Collected fluid may be much purer than source fluid that is then later dispersed in a gas stream. For example, collected water can be much purer than circulating water in a cooling tower. Contamination may enter collected fluid from the presence of drift that is also collected with the distilled water in the plume. In some embodiments, collected fluid has a purity (e.g., contaminants concentration) that is at least 5× and no more than 50× higher (e.g., at least 5× and no more than 50× lower contaminants concentration) than a purity of the fluid before the fluid entered the gas stream. Collected water may be used as a source of fresh water, as the water does not have to be used for cooling but can be used for other municipal uses. For example, collection conduit can carry collected fluid away from collection panel(s) and towards a storage tank, municipal water system, or other water circulating system.

In some embodiments, a system is installed at a cooling tower where an optimization algorithm for the tower is modified to optimize for both water and energy consumption. In previous systems, the temperature of the recirculating water is mostly selected to optimize for energy costs (e.g., from pumping, etc.). By adding a collection system as disclosed herein, a new optimization that takes water into account in the equation may be used and lead to even higher savings, since more water can be collected if the cooling tower was operated in another way (e.g., higher hot water temperature).

Figure 10A:
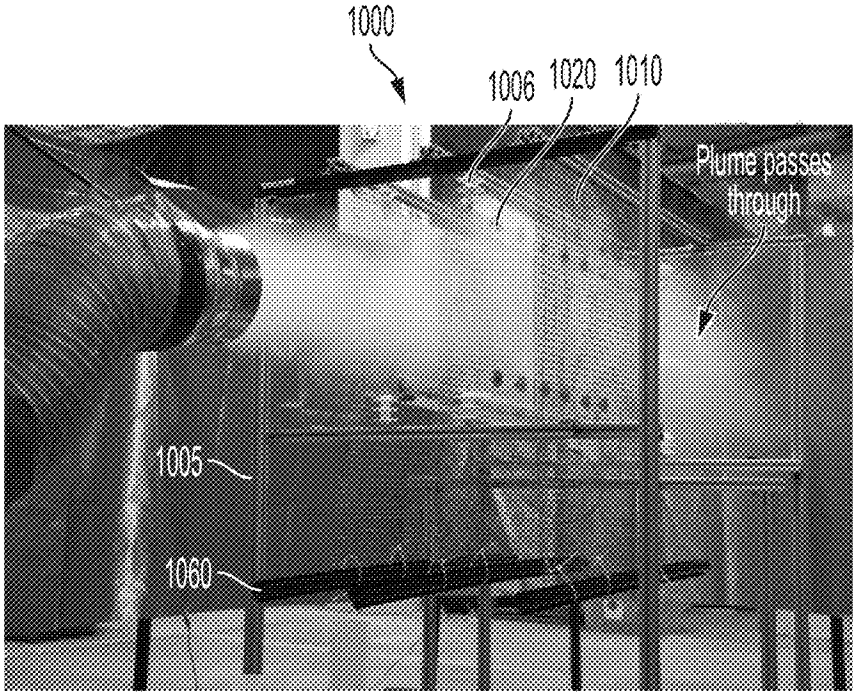
FIG. 10A-10B show a water plume interacting with a species collection system with and without applied voltage (applied electric field), according to illustrative embodiments of the present disclosure.
Figure 10B:
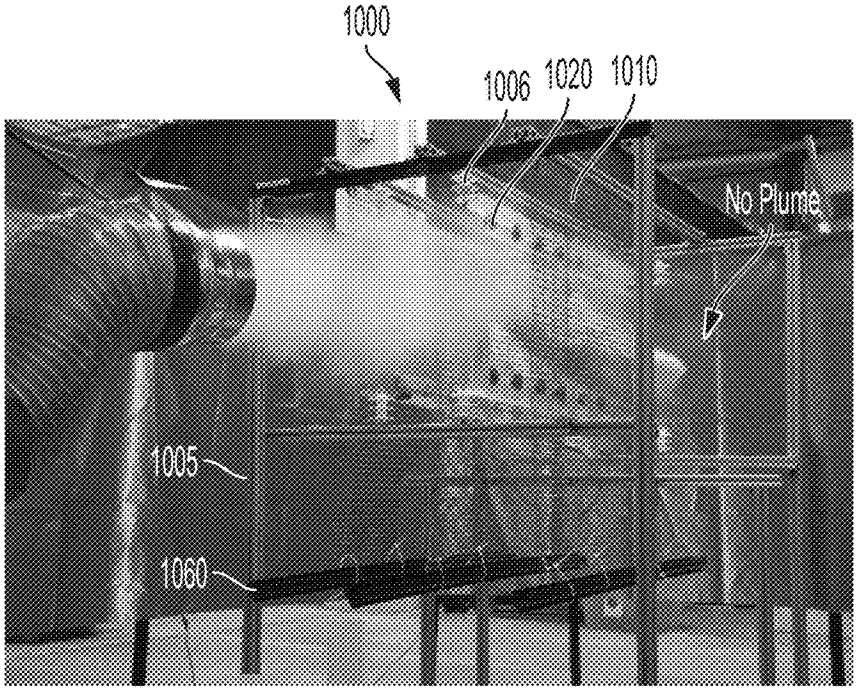
Figure 11:
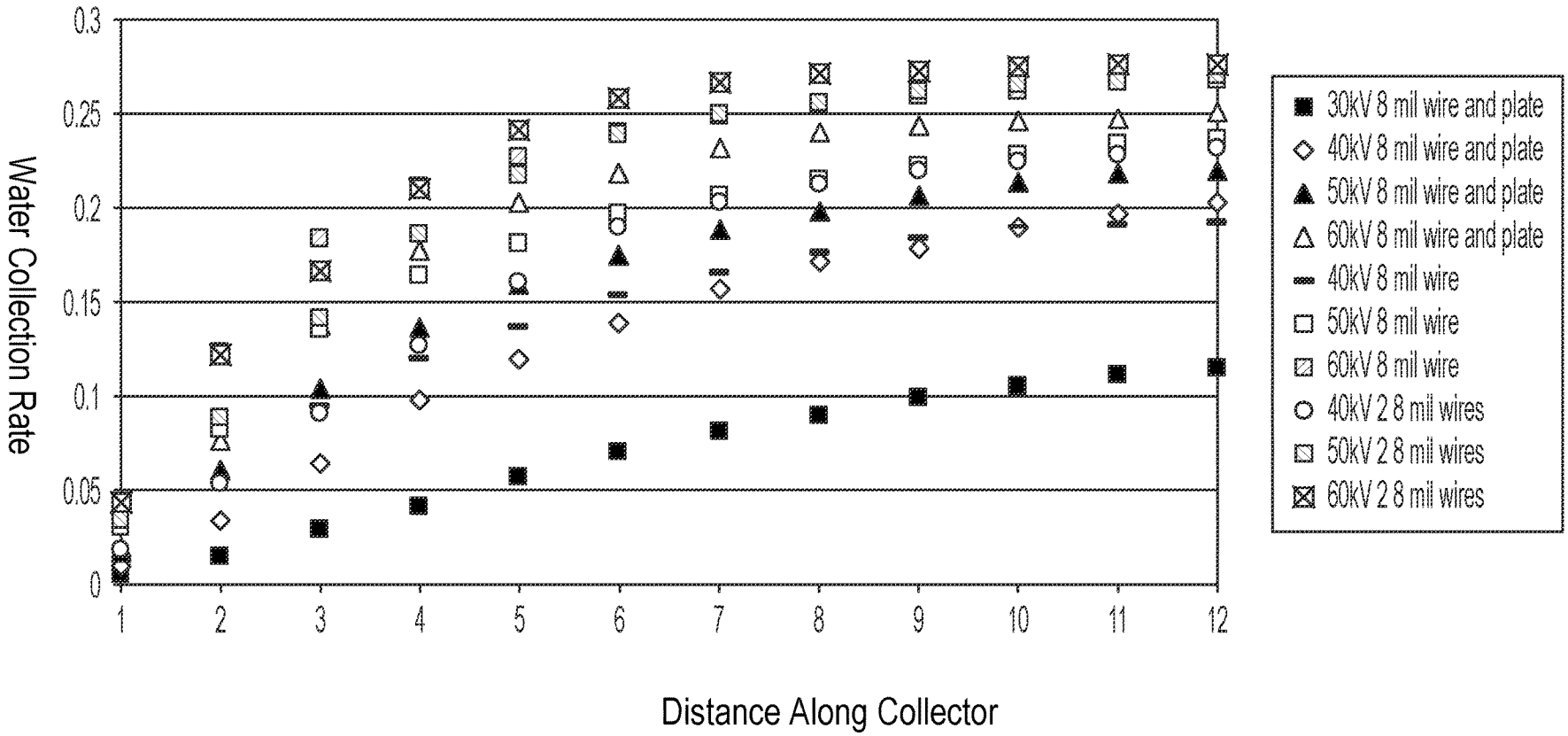
FIG. 11 is a plot of water collection rate versus distance along a collector for various illustrative configurations of species collection systems.

FIGS. 10A-10B show an example of a species collection system 1000 being used to collect water from a plume. In FIG. 10A, no voltage is applied so there is no charging of water in the plume or electric field to deflect the water. The plume passes through species collection system 1000. In FIG. 10B, a voltage is applied to emitter electrodes 1020 in species collection system 1000 that causes charging of the passing water in the plume and an electric field that deflects it towards collectors 1010. Water from the plume is collected on collectors 1010 and drained into gutters 1060 due to gravity. Insulating members 1006 electrically insulate collectors 1010 from emitter electrodes 1020 and are used to physically attach emitter electrodes 1020 to frame 1005 to which collectors 1010 are attached. (Emitter electrodes 1020 are not directly attached collectors 1010.) Frame 1005 is metal. Collectors 1010 are parallel (e.g., within 10 degrees) and aligned with a direction of gas flow in the plume. Emitter electrodes 1020 are wires wound around capstans. As can be seen in FIG. 10B, with sufficiently high voltage, the plume is entirely abated by species collection system 1000 such that none passes through the far side. FIG. 11 shows a plot of water collection rates from plumes versus distance along a collector (measured in a direction of gas flow from which the water is collected) for various combinations of applied emitter electrode voltage, wire gauge (of emitter electrode(s)), and optional deflection plate used to deflect water charged by a wire emitter electrode.

Certain embodiments of the present disclosure were described above. It is, however, expressly noted that the present disclosure is not limited to those embodiments, but rather the intention is that additions and modifications to what was expressly described in the present disclosure are also included within the scope of the disclosure. Moreover, it is to be understood that the features of the various embodiments described in the present disclosure were not mutually exclusive and can exist in various combinations and permutations, even if such combinations or permutations were not made express, without departing from the spirit and scope of the disclosure. Having described certain implementations of species capture systems, apparatus, and methods, it will now become apparent to one of skill in the art that other implementations incorporating the concepts of the disclosure may be used. Therefore, the disclosure should not be limited to certain implementations, but rather should be limited only by the spirit and scope of the following claims.

What is claimed is:

1. A system for collecting water from a plume emanating from a gas outlet, the system comprising:

a plurality of electrically conductive collectors that are spaced apart;

a plurality of emitter electrodes; and one or more ambient wind breaks, wherein at least one of the plurality of emitter electrodes is disposed between an adjacent two of the plurality of electrically conductive collectors, wherein the plurality of collectors and the plurality of emitters are disposed at the gas outlet such that the plurality of emitters are operable to cause the water to be collected from the plume by the plurality of collectors, and wherein the one or more ambient wind breaks are disposed at a periphery of the system above the gas outlet.

2. The system of claim 1, wherein the at least one of the plurality of emitter electrodes comprises two emitter electrodes and is disposed between a pair of adjacent collectors in the plurality of electrically conductive collectors and an emitter separation between adjacent ones of the at least one of the plurality of emitter electrodes is from a fourth to five times a collector separation between the adjacent collectors.

3. The system of claim 1, comprising a collector frame and a first emitter frame, wherein the electrically conductive collectors are attached to the collector frame and the plurality of emitter electrodes are attached to the first emitter frame, and wherein the collector frame is electrically insulated from the first emitter frame.

4. The system of claim 3, comprising one or more electrically insulating members that attach the first emitter frame to the collector frame and electrically insulate the collector frame from the first emitter frame.

5. The system of claim 4, wherein each of the one or more electrically insulating members is enclosed in a respective housing.

6. The system of claim 1, wherein the plurality of electrically conductive collectors are at least partially enclosed by a shielding.

7. The system of claim 1, wherein each of the electrically conductive collectors is attached to one or more pieces of edging and the one or more pieces of edging are held under tension-such that the electrically conductive collectors are held under tension.

8. The system of claim 1, comprising a gutter disposed at an edge of one of the plurality of electrically conductive collectors.

9. The system of claim 8, wherein the gutter comprises one or more collection wings.

10. The system of claim 1, comprising a motion stage, wherein the plurality of electrically conductive collectors and the plurality of emitter electrodes are mounted on the motion stage and the motion stage is operable to move the plurality of electrically conductive collectors and the plurality of emitter electrodes.

11. The system of claim 1, wherein the plurality of electrically conductive collectors and the plurality of emitter electrodes are disposed in a curved or pyramidal arrangement.

12. The system of claim 1, wherein the plurality of electrically conductive collectors and the plurality of emitter electrodes are disposed away from the gas outlet by a distance of no more than five times an extent of the gas outlet.

13. The system of claim 1, wherein the system is disposed near the gas outlet such that the plurality of electrically conductive collectors are disposed near a surface of maximum fluid content of gas exiting the gas outlet.

14. The system of claim 1, wherein the electrically conductive collectors each have a height in inches that is in a range from $h_0$ to $20h_0$ where $$h_0 = \frac{3 * \text{air speed}\left(\frac{m}{s}\right) * \text{distance between collectors (inches)}}{\text{Droplet or particle diameter } (\mu m)}.$$

15. The system of claim 1, wherein the plurality of emitter electrodes comprises one or more of round wires, square wires, rods with sharp edges, and an array of needles.

16. The system of claim 1, wherein each of the plurality of electrically conductive collectors is a mesh or a plate.

17. The system of claim 1, wherein the plurality of collectors are grounded and the plurality of emitter electrodes are maintained at a voltage and the voltage for at least some of the plurality of emitter electrodes is at least 1 kV and no more than 500 kV.

18. The system of claim 1, wherein the one or more wind breaks are disposed above the gas outlet and below a top of the plurality of emitter electrodes and the plurality of collectors.

19. The system of claim 1, wherein the one or more wind breaks comprises one or more louvers.

20. The system of claim 1, wherein the one or more wind breaks comprise one or more curved structures.

21. The system of claim 1, wherein the plurality of collectors are aligned with a direction of flow of the plume.

22. The system of claim 21, wherein the plurality of emitters are attached to and electrically insulated from the plurality of collectors at a side of the plurality of collectors relative to the direction of flow.

23. The system of claim 1, wherein the gas outlet is an outlet of a cooling tower.

24. A species collection device comprising:

an emitter electrode;

a mesh electrically conductive collector; and one or more tensioning cables, wherein the one or more tensioning cables run through the mesh collector, and the one or more tensioning cables hold the mesh under tension.

25. A system for collecting water from a plume emanating from a gas outlet, the system comprising:

a plurality of electrically conductive collectors that are spaced apart; and a plurality of emitter electrodes, wherein at least one of the plurality of emitter electrodes is disposed between an adjacent two of the plurality of electrically conductive collectors, wherein the plurality of collectors and the plurality of emitters are disposed at the gas outlet such that the plurality of emitters are operable to cause the water to be collected from the plume by the plurality of collectors, and wherein (i) the at least one of the plurality of emitter electrodes comprises two emitter electrodes, (ii) one of the two emitter electrodes is maintained at a first voltage and the other of the two emitter electrodes is maintained at a second voltage, wherein the first voltage is higher than the second voltage, and (iii) the one of the two emitter electrodes is closer to the gas outlet than the other of the two emitter electrodes.

26. A system for collecting water from a plume emanating from a gas outlet, the system comprising:

a plurality of electrically conductive collectors that are spaced apart; and a plurality of emitter electrodes, wherein at least one of the plurality of emitter electrodes is disposed between an adjacent two of the plurality of electrically conductive collectors, wherein the plurality of collectors and the plurality of emitters are disposed at the gas outlet such that the plurality of emitters are operable to cause the water to be collected from the plume by the plurality of collectors, and wherein, for at least one pair of two adjacent collectors in the plurality of electrically conductive collectors, an electrically conductive plate and at least one of the plurality of emitter electrodes is disposed between the two adjacent collectors and the electrically conductive plate is laterally separated from the at least one of the plurality of emitter electrodes and the plate is maintained at a non-zero voltage.

27. A system for collecting water from a plume emanating from a gas outlet, the system comprising:

a plurality of electrically conductive collectors that are spaced apart; and a plurality of emitter electrodes, wherein at least one of the plurality of emitter electrodes is disposed between an adjacent two of the plurality of electrically conductive collectors, wherein the plurality of collectors and the plurality of emitters are disposed at the gas outlet such that the plurality of emitters are operable to cause the water to be collected from the plume by the plurality of collectors, and wherein the electrically conductive collectors are meshes held under tension by one or more tensioning cables that run through the mesh.

* * * * *